US009551099B2

(12) United States Patent
Suzuki et al.

(10) Patent No.: US 9,551,099 B2
(45) **Date of Patent: *Jan. 24, 2017**

(54) SEWING MACHINE, NON-TRANSITORY COMPUTER-READABLE MEDIUM AND SEWING MACHINE SYSTEM

(71) Applicant: BROTHER KOGYO KABUSHIKI KAISHA, Nagoya-shi, Aichi-ken (JP)

(72) Inventors: Satomi Suzuki, Nagoya (JP); Noriharu Tashiro, Nagoya (JP); Hirotsugu Takahata, Owariasahi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 335 days.

This patent is subject to a terminal disclaimer.

(21) Appl. No.: 14/164,916

(22) Filed: Jan. 27, 2014

(65) Prior Publication Data

US 2014/0230708 A1 Aug. 21, 2014

(30) Foreign Application Priority Data

Feb. 15, 2013 (JP) ..... 2013-027494

(51) Int. Cl.
*D05B 19/12* (2006.01)
*D05B 19/08* (2006.01)
*D05C 5/00* (2006.01)

(52) U.S. Cl.
CPC ..... *D05B 19/12* (2013.01); *D05B 19/08* (2013.01); *D05C 5/00* (2013.01)

(58) Field of Classification Search
CPC ..... D05B 19/08; D05B 19/12; D05B 35/102; D05B 39/00; D05C 9/04; D05D 2207/04; B26D 5/00; G05B 2219/2626
(Continued)

(56) References Cited

U.S. PATENT DOCUMENTS 5,880,963 A 3/1999 Futamura
5,911,182 A 6/1999 Uyama et al.
(Continued)

FOREIGN PATENT DOCUMENTS

JP A-2009-172123 8/2009
JP A-2012-068746 4/2012

OTHER PUBLICATIONS

Office Action issued in U.S. Appl. No. 14/164,798 dated Apr. 25, 2014.

(Continued)

*Primary Examiner* — Tejash Patel
(74) *Attorney, Agent, or Firm* — Oliff PLC

(57) ABSTRACT

A sewing machine includes an embroidery frame moving portion, a sewing portion, a processor, and a memory. The memory is configured to store computer-readable instructions that, when executed by the processor, cause the processor to perform the steps of acquiring image data created by a device and obtained by capturing an image of a range that includes at least one reference mark and at least one indicator mark, computing positioning data based on the image data, specifying an embroidery pattern to be formed in a sewing workpiece clamped in an embroidery frame, setting at least one of a position and an angle of the embroidery pattern on the sewing workpiece, based on the positioning data, acquiring embroidery data, causing the embroidery frame moving portion and the sewing portion to form the stitches that make up the embroidery pattern in the sewing workpiece, based on the embroidery data.

13 Claims, 11 Drawing Sheets

(58) Field of Classification Search
USPC ..... 112/102.5, 103, 470.01, 470.03, 470.04,112/470.05, 470.06, 470.09, 475.19; 700/135–138
See application file for complete search history.

(56) References Cited

U.S. PATENT DOCUMENTS

| | | | | |
|---|---|---|---|---|
| 5,943,972 | A | 8/1999 | Hirata | |
| 6,167,822 | B1 | 1/2001 | Miyasako et al. | |
| 6,256,551 | B1 | 7/2001 | Muto | |
| 7,155,302 | B2 | 12/2006 | Muto et al. | |
| 7,392,755 | B2 | 7/2008 | Kato et al. | |
| 7,675,418 | B2 | 3/2010 | Agarwal et al. | |
| 7,702,415 | B2 * | 4/2010 | Roos | D05B 19/10 112/102.5 |
| 8,061,286 | B2 | 11/2011 | Hirata et al. | |
| 8,091,493 | B2 | 1/2012 | Tokura | |
| 8,196,535 | B2 | 6/2012 | Tokura | |
| 8,245,219 | B2 | 8/2012 | Agarwal et al. | |
| 8,301,292 | B2 | 10/2012 | Tokura | |
| 8,463,420 | B2 | 6/2013 | Tokura | |
| 8,473,090 | B2 * | 6/2013 | Yamada | D05B 19/10 112/470.01 |
| 8,527,083 | B2 | 9/2013 | Tokura | |
| 8,539,892 | B2 | 9/2013 | Tokura | |
| 8,539,893 | B2 | 9/2013 | Tokura | |
| 8,594,829 | B2 | 11/2013 | Tokura | |
| 8,607,721 | B2 * | 12/2013 | Koga | D05B 19/12 112/475.05 |
| 8,612,046 | B2 | 12/2013 | Tokura | |
| 8,720,353 | B2 | 5/2014 | Nakamura et al. | |
| 8,738,173 | B2 | 5/2014 | Tokura | |
| 8,763,541 | B2 | 7/2014 | Tokura | |
| 8,869,721 | B2 | 10/2014 | Suzuki et al. | |
| 9,127,385 | B2 * | 9/2015 | Suzuki | D05B 19/12 |
| 2009/0188413 | A1 | 7/2009 | Hirata et al. | |

OTHER PUBLICATIONS

U.S. Appl. No. 14/164,820, filed Jan. 27, 2014 in the name of Suzuki et al.
U.S. Appl. No. 14/164,798, filed Jan. 27, 2014 in the name of Suzuki et al.
Feb. 2, 2015 Office Action issued in U.S. Appl. No. 14/164,820.

* cited by examiner

| | | | | |
|---|---|---|---|---|
| SCHEMATIC DIAGRAM OF FIRST FRAME | |  |  |  |
| ID | | 1 | 2 | 3 |
| RELATIVE POSITIONS | P1 | (X11, Y11) | (X21, Y21) | (X31, Y31) |
| | P2 | (X12, Y12) | (X22, Y22) | (X32, Y32) |
| | P3 | (X13, Y13) | (X23, Y23) | (X33, Y33) |
| | P4 | (X14, Y14) | (X24, Y24) | (X34, Y34) |
| SEWING AREA SIZE | | X15, Y15 | X25, Y25 | X35, Y35 |

SEWING MACHINE, NON-TRANSITORY COMPUTER-READABLE MEDIUM AND SEWING MACHINE SYSTEM

CROSS-REFERENCE TO RELATED APPLICATION

This application claims priority to Japanese Patent Application No. 2013-027494, filed Feb. 15, 2013, the content of which is hereby incorporated herein by reference in its entirety.

BACKGROUND

The present disclosure relates to a sewing machine, a non-transitory computer-readable medium, and a sewing machine system.

A sewing machine is known that in configured to easily set, on a sewing workpiece that is clamped in an embroidery frame, positions and angles where stitches that make up an embroidery pattern will be formed. For example, a sewing machine is known that is provided with an image capture device. The sewing machine may cause the image capture device to capture an image of a mark that a user has affixed to the sewing workpiece in a designated position. Based on the captured image of the mark, the sewing machine may automatically set, on the sewing workpiece, the positions and the angles for the stitches that make up the embroidery pattern.

SUMMARY

A camera is installed as the image capture device in the sewing machine that is described above. The configuration of the sewing machine is therefore complex, and the sewing machine is comparatively expensive.

Various embodiments of the broad principles derived herein provide a sewing machine, a non-transitory computer-readable medium and a sewing machine system that make it possible to easily set, on a sewing workpiece, at least one of a position and an angle where a stitch will be formed that makes up a portion of an embroidery pattern, without making the configuration of the sewing machine complicated.

Various embodiments herein provide a sewing machine that includes an embroidery frame moving portion, a sewing portion, a processor, and a memory. The embroidery frame moving portion is configured to be removably mounted with an embroidery frame and to move the embroidery frame in a movement direction. The sewing portion is configured to form a stitch in a sewing workpiece that is clamped in the embroidery frame. The memory is configured to store computer-readable instructions that, when executed by the processor, cause the processor to perform the steps of acquiring image data that are created by a device that is different from the sewing machine, computing positioning data based on the image data, specifying an embroidery pattern to be formed in the sewing workpiece that is clamped in the embroidery frame, setting at least one of a position and an angle of the embroidery pattern on the sewing workpiece, based on the positioning data, acquiring embroidery data, and causing the embroidery frame moving portion and the sewing portion to form the stitches that make up the embroidery pattern in the sewing workpiece, based on the embroidery data. The image data are image data that are obtained by capturing an image of a range that includes at least one reference mark and at least one indicator mark. The at least one reference mark is provided on the embroidery frame. The at least one indicator mark is positioned in an area inside the embroidery frame, on the sewing workpiece that is clamped in the embroidery frame. The positioning data are data that indicate at least one of a position and an angle of the at least one indicator mark in relation to the at least one reference mark. The embroidery data are data for forming stitches that make up the embroidery pattern, at the at least one of the position and the angle of the embroidery pattern on the sewing workpiece.

Various embodiments also provide a non-transitory computer-readable medium storing computer-readable instructions. When executed by a processor of a sewing machine including an embroidery frame moving portion configured to be removably mounted with an embroidery frame and to move the embroidery frame in a movement direction and a sewing portion configured to form a stitch in a sewing workpiece clamped in the embroidery frame, the computer-readable instructions cause the processor to perform the steps of acquiring image data that are created by a device that is different from the sewing machine, computing positioning data based on the image data, specifying an embroidery pattern to be formed in the sewing workpiece that is clamped in the embroidery frame, setting at least one of a position and an angle of the embroidery pattern on the sewing workpiece, based on the positioning data, acquiring embroidery data, and causing the embroidery frame moving portion and the sewing portion to form the stitches that make up the embroidery pattern in the sewing workpiece, based on the embroidery data. The image data are image data that are obtained by capturing an image of a range that includes at least one reference mark and at least one indicator mark. The at least one reference mark is provided on the embroidery frame. The at least one indicator mark is positioned in an area inside the embroidery frame, on the sewing workpiece that is clamped in the embroidery frame. The positioning data are data that indicate at least one of a position and an angle of the at least one indicator mark in relation to the at least one reference mark. The embroidery data are data for forming stitches that make up the embroidery pattern, at the at least one of the position and the angle of the embroidery pattern on the sewing workpiece.

Various embodiments further provide a sewing machine system that includes a sewing machine, an embroidery frame, and a device. The sewing machine includes an embroidery frame moving portion, a sewing portion, a first processor, and a first memory. The embroidery frame moving portion is configured to removably mounted with the embroidery frame and to move the embroidery frame in a movement direction. The sewing portion is configured to form a stitch in a sewing workpiece that is clamped in the embroidery frame. The sewing portion includes a needle bar. The first memory is configured to store computer-readable instructions that, when executed by the first processor, cause the first processor to perform the steps of acquiring image data that are created by the device, computing positioning data based on the image data, specifying an embroidery pattern to be formed in the sewing workpiece that is clamped in the embroidery frame, setting at least one of a position and an angle of the embroidery pattern on the sewing workpiece, based on the positioning data, acquiring embroidery data, and causing the embroidery frame moving portion and the sewing portion to form the stitches that make up the embroidery pattern in the sewing workpiece, based on the embroidery data. The image data are image data that are obtained by capturing an image of a range that includes at least one reference mark and at least one indicator mark. The at least one reference mark is provided on the embroidery frame. The at least one indicator mark is positioned in an area inside the embroidery frame, on the sewing workpiece that is clamped in the embroidery frame. The positioning data are data that indicate at least one of a position and an angle of the at least one indicator mark in relation to the at least one reference mark. The embroidery data are data for forming stitches that make up the embroidery pattern, at the at least one of the position and the angle of the embroidery pattern on the sewing workpiece. The embroidery frame includes a mounting portion and a clamping portion. The mounting portion is configured to be mounted on and removed from the embroidery frame moving portion. The clamping portion includes a first frame and a second frame. The first frame and the second frame are configured to clamp a sewing workpiece. The clamping portion has the at least one reference mark that is disposed at a visible position on a side of the clamping portion that is opposite the needle bar in a state in which the sewing workpiece is clamped. The device includes an image capture portion, a second processor, and a second memory. The image capture portion is configured to create image data. The second memory is configured to store computer-readable instructions that, when executed by the second processor, cause the second processor to perform the steps of causing the image capture portion to create the image data by causing the image capture portion to capture the image of the range that includes the at least one reference mark and the at least one indicator mark, and outputting the image data to the sewing machine.

BRIEF DESCRIPTION OF THE DRAWINGS

Embodiments will be described below in detail with reference to the accompanying drawings in which.

DETAILED DESCRIPTION

Figure 1:
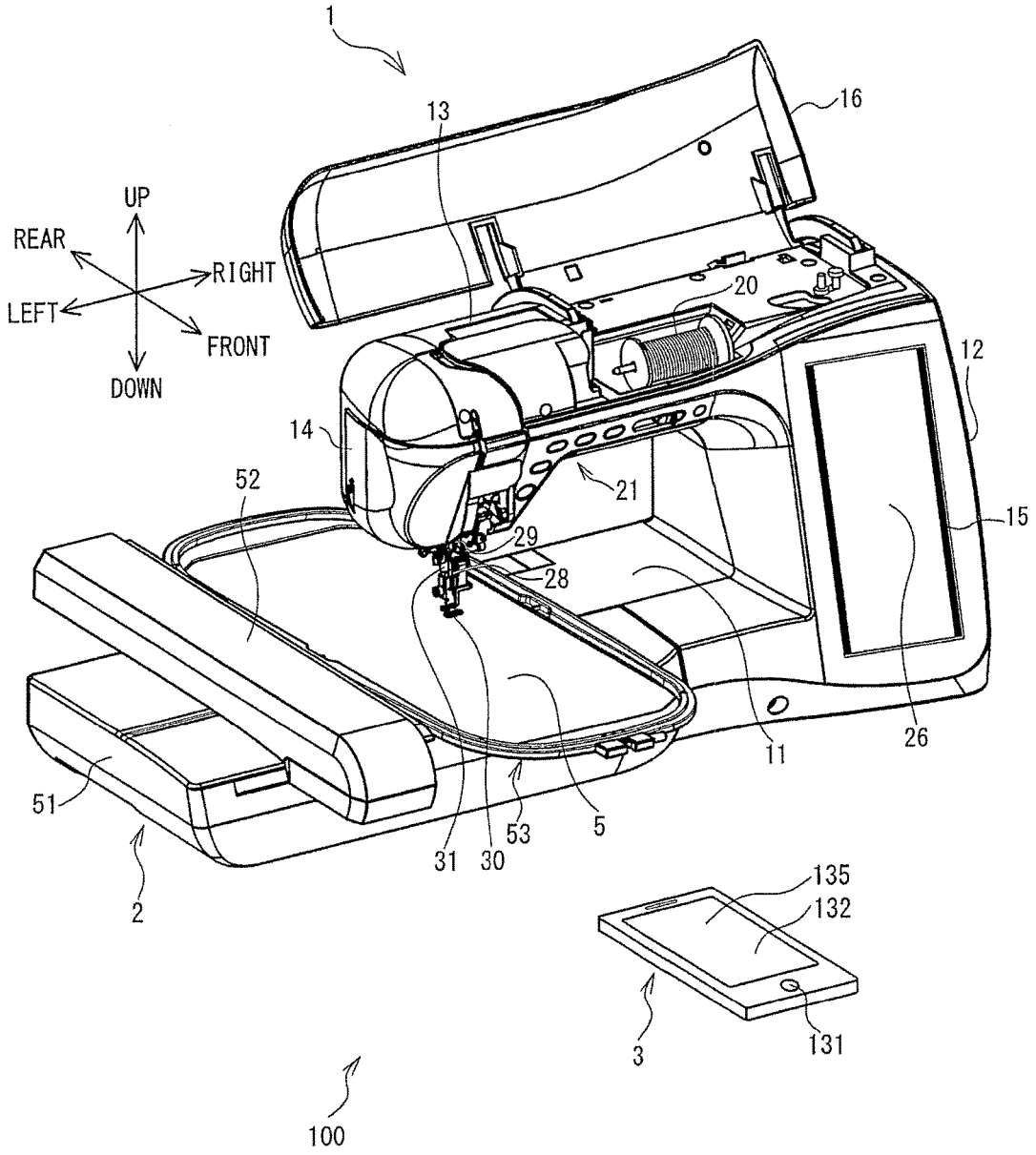
FIG. 1 is an oblique view of a sewing machine system that includes a sewing machine, a portable terminal, and an embroidery frame.

Hereinafter, an embodiment will be explained with reference to the drawings. First, a sewing machine system 100 will be explained with reference to FIGS. 1 to 4. As shown in FIG. 1, the sewing machine system 100 mainly includes a sewing machine 1, a portable terminal 3, and an embroidery frame 53. Each of the sewing machine 1 and the portable terminal 3 is configured to be connectable to a network 9 (refer to FIG. 4). The network 9 may be a public network, for example. Hereinafter, physical configurations of the sewing machine 1, the portable terminal 3, and the embroidery frame 53 will be explained in that order. The top side, the bottom side, the lower left side, the upper right side, the upper left side, and the lower right side in FIG. 1 respectively correspond to the top side, the bottom side, the left side, the right side, the rear side, and the front side of the sewing machine 1 and the portable terminal 3. The top side, the bottom side, the left side, the right side, the rear side, and the front side in FIG. 2 respectively correspond to the rear side, the front side, the left side, the right side, the bottom side, and the top side of the embroidery frame 53.

The sewing machine 1 is configured to sew an embroidery pattern. As shown in FIG. 1, the sewing machine 1 includes a bed 11, a pillar 12, and an arm 13. The bed 11 is a base portion of the sewing machine 1, and extends in the left-right direction. The pillar 12 extends upward from the right end of the bed 11. The arm 13 extends to the left from the upper end of the pillar 12, such that the arm 13 is opposite the bed 11. The left end portion of the arm 13 is a head 14.

A needle plate (not shown in the drawings) is provided in the top face of the bed 11. A feed dog (not shown in the drawings), a feed mechanism 85 (refer to FIG. 4), a feed motor 80 (refer to FIG. 4), and a shuttle mechanism (not shown in the drawings) are provided underneath the needle plate, that is, inside the bed 11. The feed dog may be driven by the feed mechanism 85 and is configured to feed a sewing workpiece in a specified feed direction (one of toward the front and toward the rear of the sewing machine 1). The sewing workpiece may be a work cloth, for example. The feed mechanism 85 is a mechanism that is configured to drive the feed dog in the up-down direction and in the front-rear direction. A bobbin around which a lower thread is wound can be accommodated in the shuttle mechanism. The shuttle mechanism is a mechanism that is configured to form a stitch in the sewing workpiece by operating in coordination with a sewing needle 28 that is mounted on the lower end of a needle bar 29, which will be described later. The feed motor 80 is a pulse motor for driving the feed mechanism 85.

A well-known embroidery device 2 that is used during embroidery sewing can be mounted on the bed 11. When the embroidery device 2 is mounted on the sewing machine 1, the embroidery device 2 and the sewing machine 1 are electrically connected. When the embroidery device 2 and the sewing machine 1 are electrically connected, the embroidery device 2 can move a sewing workpiece 5 that is held by the embroidery frame 53. The embroidery device 2 includes a body 51 and a carriage 52.

The carriage 52 is provided on the top side of the body 51. The carriage 52 has a three-dimensional rectangular shape, with its longer axis extending in the front-rear direction. The carriage 52 includes a frame holder (not shown in the drawings), a Y axis moving mechanism 88 (refer to FIG. 4), and a Y axis motor 83 (refer to FIG. 4). The frame holder is configured such that an embroidery frame can be mounted on and removed from the frame holder. A plurality of types of embroidery frames are available that differ from one another in at least one of size and shape. Hereinafter, when the plurality of the different types of the embroidery frames are referenced collectively, they will be called the embroidery frames 53, and when one of the plurality of the different types of the embroidery frames is referenced without being specifically identified, it will be called the embroidery frame 53. The configurations of the embroidery frames 53 and the types of the embroidery frames 53 will be described later. The frame holder is provided on the right side face of the carriage 52. The sewing workpiece 5 that is held by the embroidery frame 53 is disposed on the top side of the bed 11, below the needle bar 29 and a presser foot 30. The Y axis moving mechanism 88 is configured to move the frame holder in the front-rear direction (in a Y axis direction). The moving of the frame holder in the front-rear direction causes the embroidery frame 53 to move the sewing workpiece 5 in the front-rear direction. The Y axis motor 83 is configured to drive the Y axis moving mechanism 88. A CPU 61 of the sewing machine 1 (refer to FIG. 4) is configured to control the Y axis motor 83 in accordance with coordinate data that will be described later.

An X axis moving mechanism 87 (refer to FIG. 4) and an X axis motor 82 (refer to FIG. 4) are provided in the interior of the body 51. The X axis moving mechanism 87 is configured to move the carriage 52 in the left-right direction (in an X axis direction). The moving of the carriage 52 in the left-right direction causes the embroidery frame 53 to move the sewing workpiece 5 in the left-right direction. The X axis motor 82 is configured to drive the X axis moving mechanism 87. The CPU 61 of the sewing machine 1 is configured to control the X axis motor 82 in accordance with the coordinate data that will be described later.

A liquid crystal display (hereinafter called the LCD) 15 is provided on the front face of the pillar 12. Images that include various items such as commands, illustrations, setting values, messages, and the like may be displayed on the LCD 15. A touch panel 26 that is configured to detect a position that is pressed is provided on the front side of the LCD 15. When the user performs a pressing operation on the touch panel 26 using a finger or a stylus pen, the position that is pressed is detected by the touch panel 26. The item that has been selected within the image is then recognized based on the pressed position that has been detected. Hereinafter, the operation in which the touch panel 26 is pressed by the user will be called a panel operation. The user can use a panel operation to select a pattern to be sewn or a command to be executed.

A connector (not shown in the drawings) is provided in the right side face of the pillar 12. The sewing machine 1 can be connected to an external device through the connector. Examples of the external device include a personal computer (PC), an image capture device, and a portable terminal, for example.

A cover 16 that can be opened and closed is provided in an upper portion of the arm 13. FIG. 1 shows the cover 16 in an opened state. A thread spool 20 may be accommodated underneath the cover 16, that is approximately in the center of the interior of the arm 13. An upper thread (not shown in the drawings) that is wound around the thread spool 20 may be supplied from the thread spool 20, through a thread guide portion (not shown in the drawings) that is provided in the head 14, to the sewing needle 28 that is mounted on the needle bar 29. A plurality of operation switches 21 that include a start/stop switch are provided in a lower portion of the front face of the arm 13.

A presser mechanism 90 (refer to FIG. 4), a needle bar up-and-down moving mechanism 84 (refer to FIG. 4), a needle bar swinging mechanism 86 (refer to FIG. 4), a swinging motor 81 (refer to FIG. 4), and the like are provided inside the head 14. The presser mechanism 90 is a mechanism that is configured to drive a presser bar 31, using a presser motor 89 (refer to FIG. 4) as a drive source. The needle bar up-and-down moving mechanism 84 is a mechanism that is configured to drive the needle bar 29 up and down in accordance with the rotation of a drive shaft (not shown in the drawings). The needle bar up-and-down moving mechanism 84 may be driven by a sewing machine motor 79 (refer to FIG. 4). The needle bar 29 and the presser bar 31 extend downward from the bottom edge of the head 14. The sewing needle 28 can be mounted on and removed from the lower end of the needle bar 29. The presser foot 30 can be mounted on and removed from the lower end of the presser bar 31. The presser foot 30 can press against the sewing workpiece 5 from above such that the sewing workpiece 5 can be fed. The needle bar swinging mechanism 86 is a mechanism that is configured to swing the needle bar 29 in a direction (the left-right direction) that is orthogonal to the direction (the front-rear direction) in which the sewing workpiece 5 is fed by the feed dog. The swinging motor 81 is a pulse motor that is configured to drive the needle bar swinging mechanism 86.

In the sewing machine 1, when a stitch is formed using the embroidery device 2, the embroidery frame 53 is moved by the Y axis moving mechanism 88 and the X axis moving mechanism 87 to a needle drop point that is indicated in terms of an embroidery coordinate system that is specific to the sewing machine 1. The embroidery coordinate system is the coordinate system for the X axis motor 82 and the Y axis motor 83 that are configured to move the carriage 52. In the present embodiment, the embroidery coordinate system is set as will now be described. The left-right direction of the sewing machine 1 is the X axis direction, and the direction from left to right is the positive direction on the X axis. The front-rear direction of the sewing machine 1 is the Y axis direction, and the direction from front to rear is the positive direction on the Y axis. The needle drop point is the point where the sewing needle 28, which is positioned directly above a needle hole (not shown in the drawings), pierces the sewing workpiece 5 when the needle bar 29 is moved downward from above the sewing workpiece 5. The stitches that make up the pattern on the sewing workpiece 5 may be formed by the driving of the shuttle mechanism (not shown in the drawings) and the needle bar 29 on which the sewing needle 28 is mounted, in concert with the moving of the embroidery frame 53. The X axis motor 82, the Y axis motor 83, the needle bar 29, and the like may be controlled by the CPU 61, which is built into the sewing machine 1 and will be described later, based on the coordinate data, which will be described later. When an ordinary utility stitch pattern that is not an embroidery pattern is sewn, the sewing may be performed in a state in which the embroidery device 2 has been removed from the bed 11, and the sewing workpiece 5 is moved by the feed dog (not shown in the drawings).

The physical configuration of the portable terminal 3 will be explained with reference to FIG. 1. The portable terminal 3 is a well-known multi-functional mobile telephone (that is, a so-called smartphone). On the top face, the portable terminal 3 includes an operation switch 131, a touch panel 132, and a display portion 135. The operation switch 131 may be used for inputting various types of commands to the portable terminal 3. Images that include various items such as commands, illustrations, setting values, messages, and the like may be displayed on the display portion 135. The touch panel 132 is provided on the front side of the display portion 135 and is configured to detect a position that is pressed. When the user performs a pressing operation on the touch panel 132 using a finger or a stylus pen, the position that is pressed is detected by the touch panel 132. The item that has been selected within the image is then recognized based on the pressed position that has been detected. The portable terminal 3 includes a camera 136 (refer to FIG. 4) on its bottom face. The camera 136 may be a well-known complementary metal oxide semiconductor (CMOS) image sensor, for example.

Figure 2:
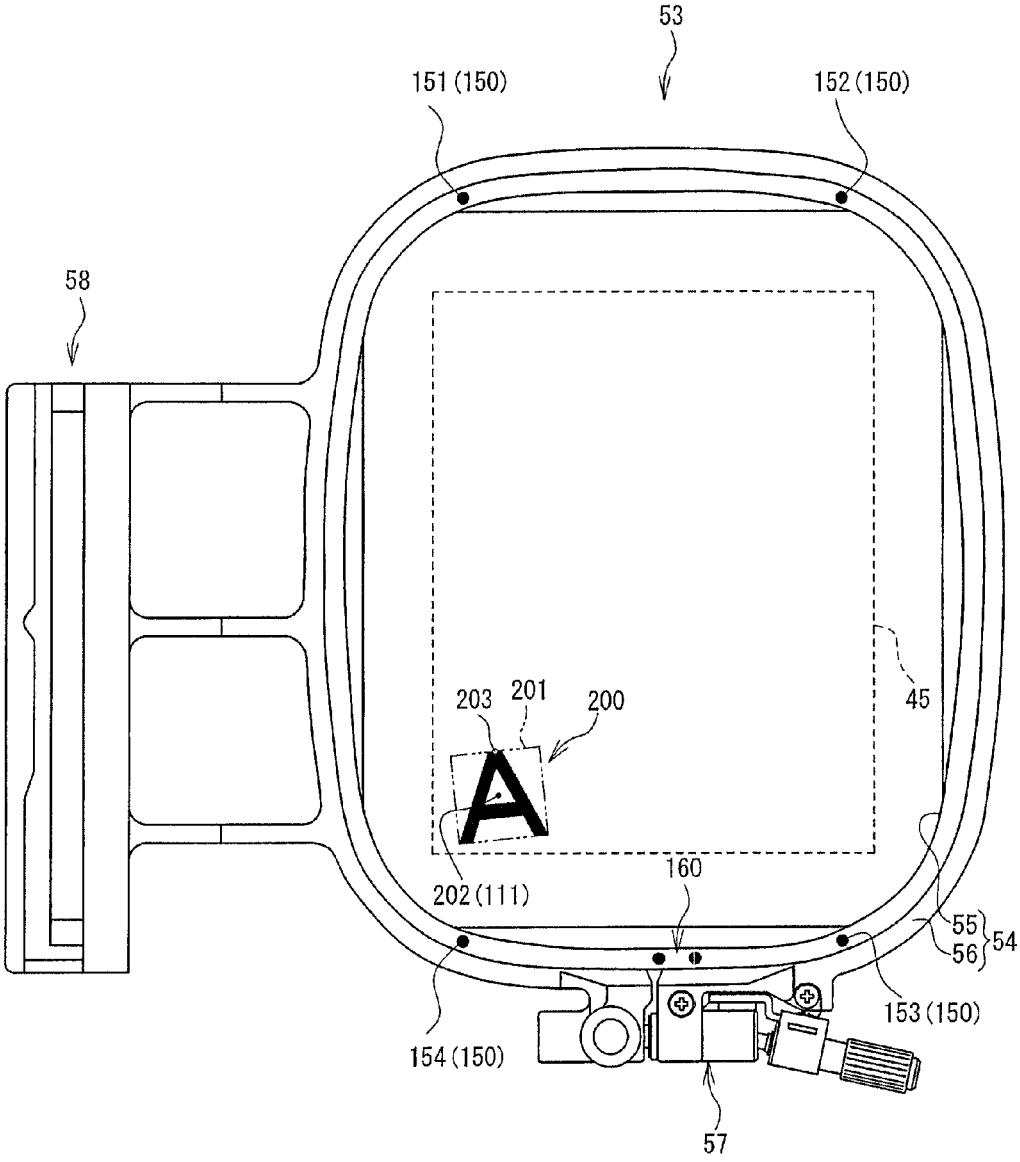
FIG. 2 is a plan view of the embroidery frame.

The physical configuration of embroidery frame 53 will be explained with reference to FIG. 2. As shown in FIG. 2, the embroidery frame 53 includes a mounting portion 58 and a clamping portion 54. The mounting portion 58 is configured to be mounted on and removed from the frame holder (not shown in the drawings) of the embroidery device 2 that is mounted on the sewing machine 1. The clamping portion 54 includes a first frame 55 and a second frame 56. The first frame 55 and the second frame 56 are configured to clamp the sewing workpiece 5. The first frame 55 and the second frame 56 are each a rectangular frame-shaped member whose longer axis extends in the front-rear direction and whose corners are rounded. The inner circumferential shape of the second frame 56 is substantially identical to the outer circumferential shape of the first frame 55. The first frame 55 is configured to be fitted inside of and removed from the second frame 56. A parting portion 57 that is divided in a central portion of its longer dimension (the left-right direction) is provided on the front side of the second frame 56. A tightening mechanism that tightens the second frame 56 in relation to the first frame 55 is provided in the parting portion 57. The sewing workpiece 5 may be clamped between the first frame 55 and the second frame 56 and may be held in a taut state by the tightening mechanism.

In a state in which the clamping portion 54 has clamped the sewing workpiece 5 and the embroidery frame 53 is mounted in the frame holder of the embroidery device 2, the top face of the first frame 55 can be visually recognized on the side that faces the needle bar 29 of the sewing machine 1. Reference marks 151 to 154 are respectively disposed at the left rear, the right rear, the right front, and the left front of top face of the first frame 55. Hereinafter, when the plurality of the reference marks 151 to 154 are referenced collectively, they will be called the reference marks 150, and when one of the reference marks 151 to 154 is referenced without being specifically identified, it will be called the reference mark 150. The reference mark 150 is a mark that is expressed in the form of a single round, black pattern (hereinafter simply called the round, black pattern). The reference marks 150 may be used as references when at least one of a position and an angle of an indicator mark 110 that will be described later is computed based on image data for an image of the embroidery frame 53 that is captured in a state in which the sewing workpiece 5 is clamped in the embroidery frame 53. It is preferable for the positioning of the reference marks 150 to be determined by taking into consideration an area in which the indicator mark 110 is possibly disposed, that is, a sewing area 45. The sewing area 45 is an area that is set inside the first frame 55 and within which a stitch can be formed by the sewing machine 1. The sewing area 45 differs according to the type of the embroidery frame 53. In the present embodiment, the reference marks 150 are disposed close to four corners of the sewing area 45, respectively.

Figure 3:
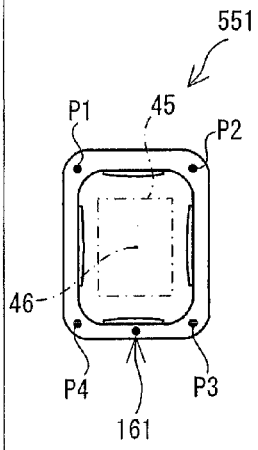
FIG. 3 is an explanatory figure that shows correspondence relationships among schematic diagrams of first frames, which show three types of the embroidery frames whose sizes differ, identification information (IDs) for identifying the types of the embroidery frames, relative positions of characteristic points that are included in reference marks, and sizes of sewing areas.
Figure 3:
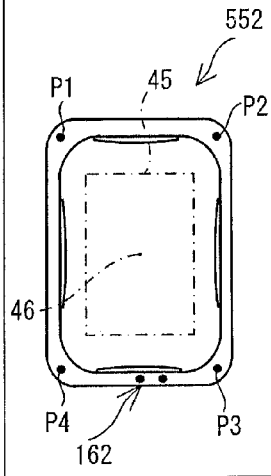
Figure 3:
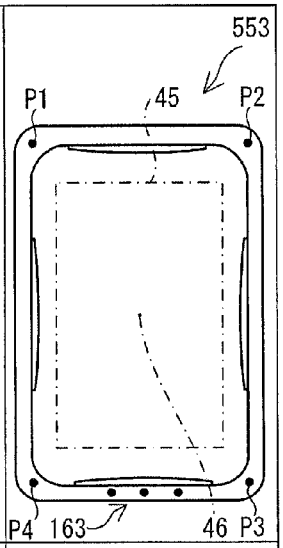

A type mark 160 is disposed on the front side of the top face of the first frame 55. The type mark 160 is a mark that indicates the type of the embroidery frame 53 and the orientation of the embroidery frame 53 within a captured image that will be described later. As described previously, selected one of the plurality of types of the embroidery frames 53 that differ from one another in at least one of size and shape can be mounted on the embroidery device 2. In the explanation that follows, a case in which selected one of three types of the embroidery frames 53 that differ in size can be mounted on the embroidery device 2 will be used as an example. FIG. 3 shows schematic drawings of first frames 551, 552, and 553 for three types of the embroidery frames 53. In the present embodiment, the type mark 160 includes at least one round, black pattern. The three types of the first frames 551, 552, and 553 respectively have type marks 161, 162, and 163. Each of the type marks 161, 162, and 163 includes at least one round, black pattern, but the number of the round, black patterns is different from that for the other two. In the present embodiment, identification information (hereinafter called the ID) for identifying the type of the embroidery frame 53 is expressed in the form of the number of the round, black patterns that are included in the type mark 160. In the present embodiment, a larger number that is indicated by the ID indicates that the size of corresponding embroidery frame 53 is larger than the size of an embroidery frame 53 for which the number that is indicated by the ID is smaller.

The type mark 161 of the first frame 551 of the embroidery frame 53 for which the ID is 1 includes one round, black pattern. The type mark 162 of the first frame 552 of the embroidery frame 53 for which the ID is 2 includes two round, black patterns. The type mark 163 of the first frame 553 of the embroidery frame 53 for which the ID is 3 includes three round, black patterns. Hereinafter, when the type marks 161 to 163 are referenced collectively, they will be called the type marks 160, and when one of the type marks 161 to 163 is referenced without being specifically identified, it will be called the type mark 160. Hereinafter, when the first frames 551 to 553 are referenced collectively, they will be called the first frames 55, and when one of the first frames 551 to 553 is referenced without being specifically identified, it will be called the first frame 55. In the present embodiment, the first frame 55 is mounted in the second frame 56, with the side where the type mark 160 is provided being defined as the front side of the embroidery frame 53. In the present embodiment, each of the reference marks 150 and the type marks 160 is printed on the top face of the first frame 55 during the manufacturing of the first frame 55. Therefore, the position of each of the reference marks 150 and the type marks 160 is fixed in relation to the embroidery frame 53.

Figure 4:
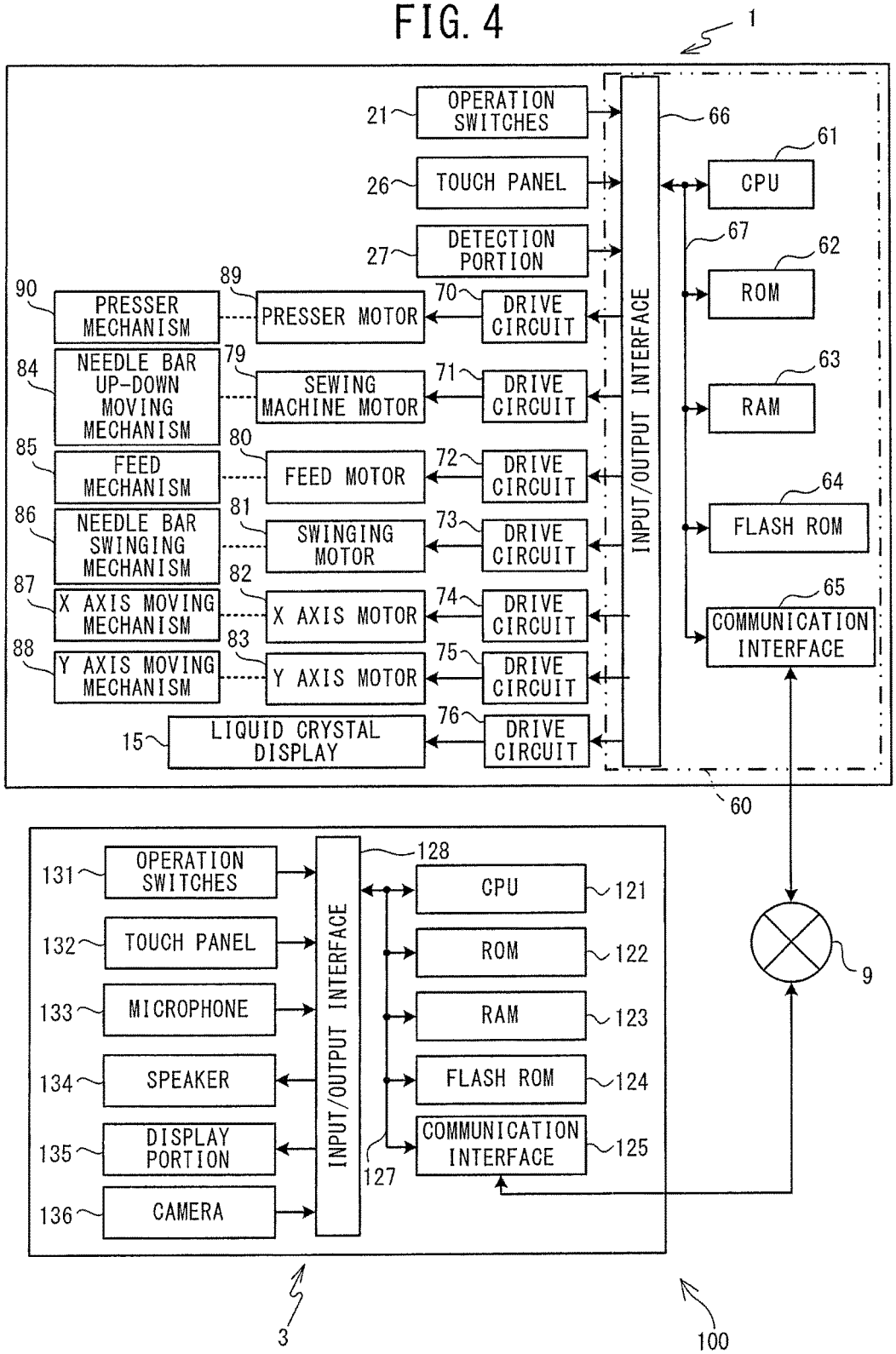
FIG. 4 is block diagram that shows an electrical configuration of the sewing machine system.

An electrical configuration of the sewing machine 1 will be explained with reference to FIG. 4. A control portion 60 of the sewing machine 1 includes the CPU 61, a ROM 62, a RAM 63, a flash ROM 64, a communication interface 65, and an input/output interface 66. The CPU 61, the ROM 62, the RAM 63, the flash ROM 64, the communication interface 65, and the input/output interface 66 are electrically connected to one another through a bus 67. Various types of programs, including a program by which the CPU 61 performs second processing that will be described later, are stored in the ROM 62, along with data and the like. A sewing area table, pattern data that will be described later, and various types of parameters for computing positioning data based on image data and the like are stored in the flash ROM 64. The sewing area table is a portion of the table that is shown in FIG. 3, and it stores correspondence relationships between the IDs, relative positions of characteristic points P1 to P4 that are included in the reference marks 150, and sizes of the sewing areas 45. In the present embodiment, a characteristic point that is included in a mark (for example, the reference mark 150) is a point that is used in processing that detects the mark and computes the position of the mark, based on image data for a captured image of the mark. The reference mark 150 of the present embodiment is a single round, black pattern. Each one of the characteristic points P1 to P4 that are included in the reference marks 151 to 154 is a center point of the round, black pattern. In the present embodiment, the sewing area 45 has a rectangular shape whose sides are parallel to the X axis and the Y axis, as shown in FIG. 2. Accordingly, the size of the sewing area 45 is expressed in the embroidery coordinate system in terms of its length along the X axis and its length along the Y axis, as shown in FIG. 3. The communication interface 65 is an interface for connecting the sewing machine 1 to the network 9.

The operation switches 21, the touch panel 26, a detection portion 27, and drive circuits 70 to 76 are electrically connected to the input/output interface 66. The detection portion 27 is configured to detect whether or not the embroidery frame 53 has been mounted in embroidery device 2, to detect the type of the embroidery frame 53 that has been mounted in the embroidery device 2, and to input the detection results to the CPU 61 through the input/output interface 66. The drive circuits 70 to 76 may respectively drive the presser motor 89, the sewing machine motor 79, the feed motor 80, the swinging motor 81, the X axis motor 82, the Y axis motor 83, and the LCD 15.

An electrical configuration of the portable terminal 3 will be explained with reference to FIG. 4. The portable terminal 3 includes a CPU 121, a ROM 122, a RAM 123, a flash ROM 124, a communication interface 125, and an input/output interface 128. The CPU 121 performs control of the portable terminal 3. The CPU 121 is electrically connected to the ROM 122, the RAM 123, the flash ROM 124, the communication interface 125, and the input/output interface 128 through a bus 127. A boot program, a BIOS, and the like are stored in the ROM 122. Data are stored temporarily in the RAM 123. A program for causing the CPU 121 to perform first processing that will be described later, and various setting values are stored in the flash ROM 124. The communication interface 125 is an interface for connecting the portable terminal 3 to the network 9.

The operation switch 131, the touch panel 132, a microphone 133, a speaker 134, the display portion 135, and the camera 136 are connected to the input/output interface 128. The microphone 133 is configured to convert ambient sounds into audio data and inputs the audio data to the input/output interface 128. The speaker 134 is configured to output sound based on audio data that is output from the input/output interface 128. The display portion 135 is configured to display an image based on image data. The display portion 135 may be a liquid crystal display, for example. The camera 136 is configured to capture an image of a specified image capture range and creates image data. The created image data may be stored in the RAM 123.

Figure 5:
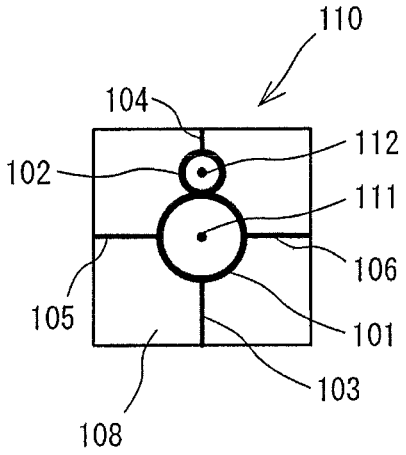
FIG. 5 is an explanatory figure of an indicator mark.

The indicator mark 110 will be explained with reference to FIG. 5. The indicator mark 110 is a mark that the user uses to indicate the positioning of an embroidery pattern 200 on the sewing workpiece 5 that is clamped in the embroidery frame 53. When the user indicates the positioning of the embroidery pattern 200 with the indicator mark 110, the user affixes the indicator mark 110 onto the sewing workpiece 5 that is clamped in the embroidery frame 53, in an area of the sewing workpiece 5 that is inside the embroidery frame 53, specifically inside the sewing area 45. The indicator mark 110 includes a thin, white sheet 108 and a line drawing that is drawn in black on the top face of the sheet 108. The sheet 108 has a square shape that is 2.5 centimeters high and 2.5 centimeters wide, for example. The line drawing that is drawn on the top face of the sheet 108 includes a first circle 101, a first center point 111 at the center of the first circle 101, a second circle 102, a second center point 112 at the center of the second circle 102, and line segments 103, 104, 105, and 106.

The first circle 101 is drawn with the center point of the square sheet 108 serving as the first center point 111. The second circle 102 is drawn in a position where it is tangent to the first circle 101 and where a virtual straight line (not shown in the drawings) that passes through the first center point 111 and the second center point 112 is parallel to one side of the sheet 108. The diameter of the second circle 102 is smaller than the diameter of the first circle 101. The line segment 103 and the line segment 104 are line segments that are superposed on the virtual straight line (not shown in the drawings) that passes through the first center point 111 and the second center point 112, and they respectively extend from the first circle 101 and the second circle 102 to an outer edge of the sheet 108. The line segment 105 and the line segment 106 are line segments that are superposed on a virtual straight line (not shown in the drawings) that passes through the first center point 111 of the first circle 101 and is orthogonal to the line segment 103, and each of them extends from an outer edge of the first circle 101 to an outer edge of the sheet 108. In the present embodiment, the first center point 111 and the second center point 112 are characteristic points of the indicator mark 110.

Figure 6:
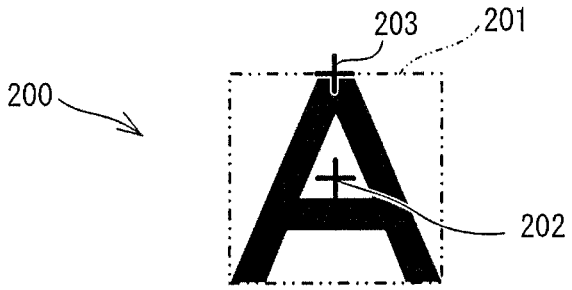
FIG. 6 is an explanatory figure of an embroidery pattern.

An embroidery pattern, the pattern data, and embroidery data will be explained using the embroidery pattern 200 that is shown in FIG. 6 as an example. Note that the left-right direction and the up-down direction in FIG. 6 respectively correspond to the X axis direction and the Y axis direction in the embroidery coordinate system.

The embroidery pattern 200 that is shown in FIG. 6 is a pattern that represents an uppercase letter A. The pattern data are data for forming the stitches that will make up the embroidery pattern 200 when the embroidery pattern 200 is in its initial position. In the present embodiment, the initial position of the embroidery pattern 200 is set at the center of the sewing area 45. The pattern data include coordinate data. The coordinate data indicate the positions of needle drop points and a sewing order of the needle drop points. In the present embodiment, the positions of the needle drop points are indicated in terms of the coordinates of the previously described embroidery coordinate system. All of the coordinate data in the pattern data are specified such that a center point 202 of the embroidery pattern 200 (more specifically, the center point of a rectangle 201 that is the smallest rectangle within which the embroidery pattern 200 can be contained) is congruent with the origin point of the embroidery coordinate system. The origin point of the embroidery coordinate system is the position at which a center point 46 of the sewing area 45 (refer to FIG. 3) becomes the needle drop point.

The embroidery data are data for forming the stitches that make up the embroidery pattern 200 at at least one of the position and the angle that the user has indicated by using the indicator mark 110. In the present embodiment, the embroidery data are data for forming the stitches that make up the embroidery pattern 200 at the position and the angle that the user has indicated by using the indicator mark 110. The embroidery data include coordinate data. In the present embodiment, all of the coordinate data in the embroidery data are specified such that the center point 202 of the embroidery pattern 200 (more specifically, the center point of the rectangle 201 that is the smallest rectangle within which the embroidery pattern 200 can be contained) is congruent with the first center point 111 of the indicator mark 110 in the embroidery coordinate system. Furthermore, in the present embodiment, the coordinate data in the embroidery data are specified such that the slope of a line segment that links the center point 202 of the embroidery pattern 200 to a point 203 will match the slope of a line segment that links the first center point 111 and the second center point 112 of the indicator mark 110 in the embroidery coordinate system.

Processing that is performed in the sewing machine system 100 of the present embodiment will be explained with reference to FIGS. 7 to 11. First, with reference to FIG. 7 and FIG. 8, the first processing that is performed by the portable terminal 3 will be explained. In the first processing, the portable terminal 3 performs processing that creates image data and outputs the created image data to the sewing machine 1. Specifically, the portable terminal 3, by controlling the camera 136, creates image data for an image that is captured such that the image includes at least the reference marks 150 of the embroidery frame 53 and the indicator mark 110, which is placed on the sewing workpiece 5 that is clamped in the embroidery frame 53 in an area of the sewing workpiece 5 that is inside the embroidery frame 53. In the present embodiment, the user sets an image capture range such that all four of the reference marks 150 will be included in the captured image. One indicator mark 110 is affixed in the area inside the embroidery frame 53. Based on the image data that have been created, the portable terminal 3 confirms that the reference marks 150 are included in the captured image, and thereafter outputs the image data to the sewing machine 1 through the communication interface 125. The embroidery frame 53 for which the ID is 2 will be used in the following explanation.

The CPU 121 of the portable terminal 3 starts the first processing when the user inputs a command to start the first processing by operating the operation switch 131. Specifically, when the CPU 121 detects the input of the command to start the first processing, the CPU 121 reads into the RAM 123 a program for performing the first processing, which is stored in the flash ROM 124 (refer to FIG. 4). In accordance with the instructions that are contained in the program, the CPU 121 performs the processing at the individual steps that will hereinafter be explained. Note that in the present embodiment, the user, prior to inputting the command to start the first processing, clamps the sewing workpiece 5 in the embroidery frame 53 and affixes the indicator mark 110 to the top face of the sewing workpiece 5. In other words, the user completes the preparation for capturing the image before inputting the command to start the first processing.

Figure 7:
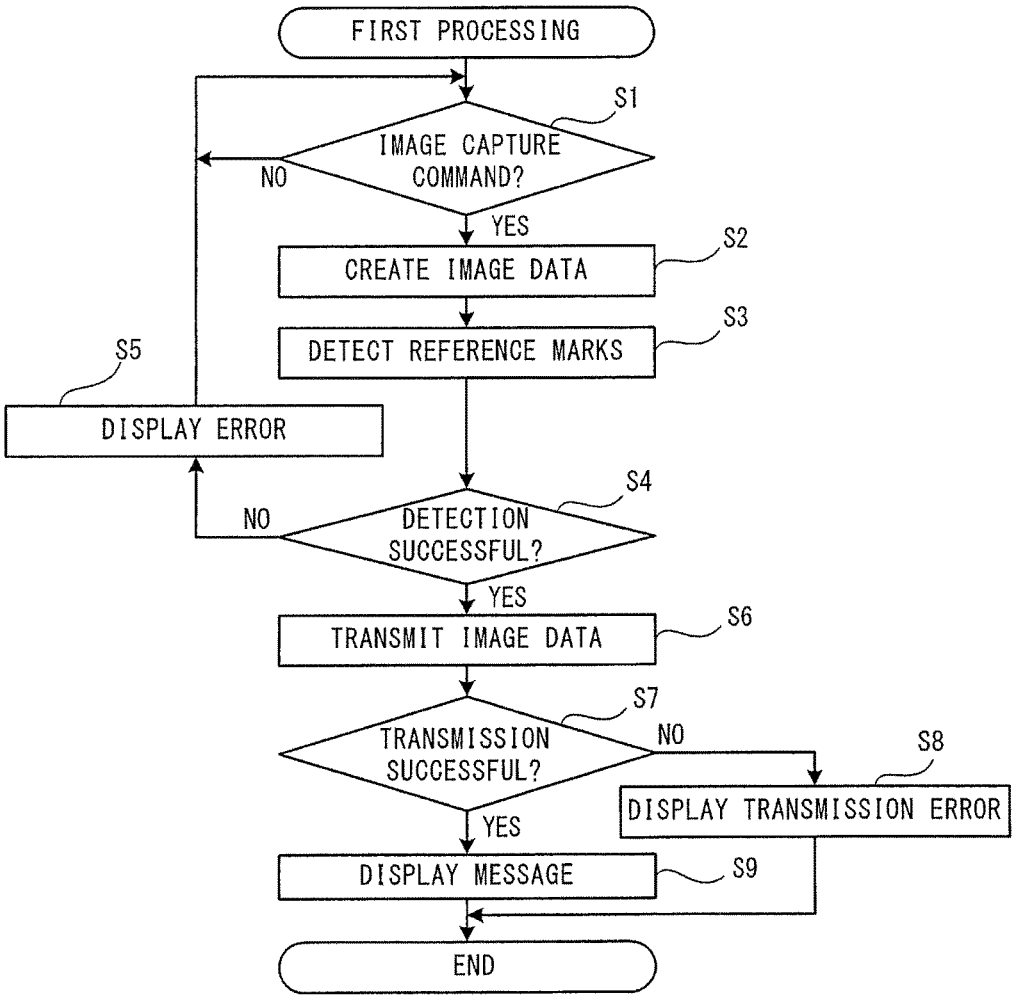
FIG. 7 is a flowchart of first processing that is performed by the portable terminal.
Figure 8:
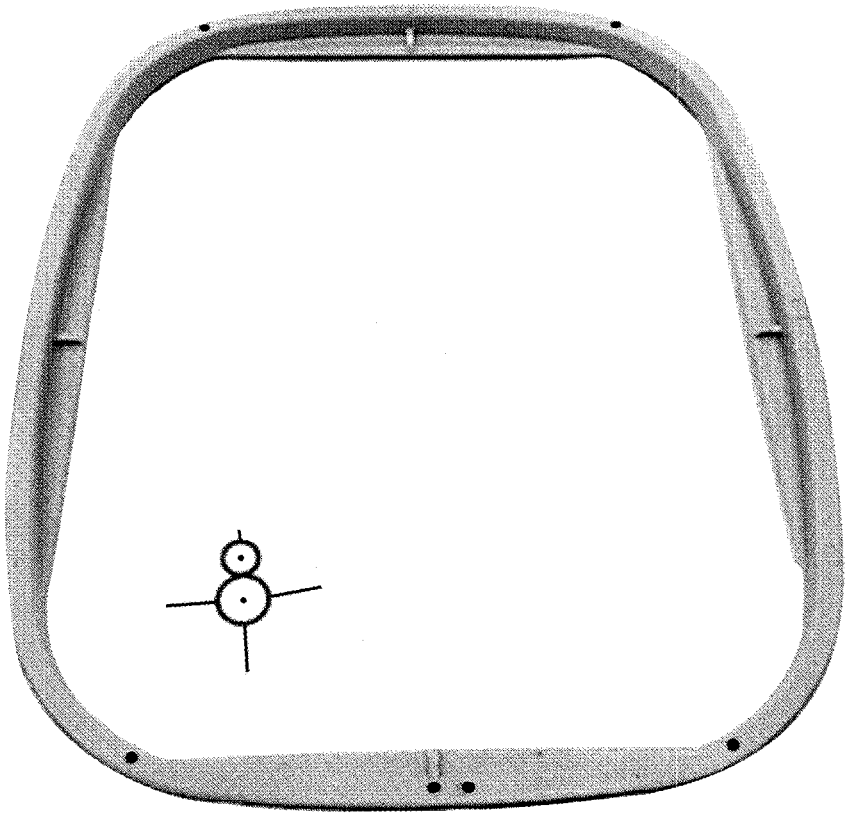
FIG. 8 is a captured image that is represented by image data created by the first processing.

As shown in FIG. 7, in the first processing, first, the CPU 121 determines whether or not an image capture command has been input (Step S1). The user may input the image capture command by operating the operation switch 131, for example. The CPU 121 causes the display portion 135 to display an image that is represented by the most recent image data that the camera 136 has created. The image that is displayed by the display portion 135 corresponds to the image capture range of the camera 136, and the center of the image is the center of the image capture range. The user may input the command to capture an image after confirming that the four reference marks 150 and the indicator mark 110, which has been placed on the sewing workpiece 5 that is clamped in the embroidery frame 53 in an area of the sewing workpiece 5 that is inside the embroidery frame 53, are located within the image capture range that is displayed by the display portion 135 of the portable terminal 3, as shown in FIG. 8, for example. Note that in the interests of simplifying the processing and improving the precision of the detection of the reference marks 150, the portable terminal 3 may also display a recommended range in which the reference marks 150 should be positioned, the recommended range being superimposed on the image that shows the image capture range. In that case, the user may adjust the image capture range by shifting the position of the portable terminal 3 such that the reference marks 150 are positioned within the recommended range, or by altering the focus of the camera 136. The image may be captured with the embroidery frame 53 in a state of being mounted on the embroidery device 2, and the image may also be captured with the embroidery frame 53 in a state of being removed from the embroidery device 2. In order to simplify the image processing, it is preferable for the image to be captured with the embroidery frame 53 in a state of being removed from the embroidery device 2. In a case where the image capture range is set in this manner, the image processing becomes simpler, because the needle bar 29, the sewing needle 28, the presser bar 31, the presser foot 30, and the like of the sewing machine 1 are not included in the captured image.

In a case where the image capture command has not been input (NO at Step S1), the CPU 121 waits until the image capture command is input. In a case where the image capture command has been input (YES at Step S1), the CPU 121 controls the camera 136 to create the image data for the image that has been captured of the image capture range, and then stores the image data in the RAM 123 (Step S2). Hereinafter, a specific example will be explained in which image data that represent the image that is shown in FIG. 8 have been created by the processing at Step S2. Based on the image data, the CPU 121 detects the reference marks 150 in the captured image (Step S3). The captured image is an image that is based on the image data that were created by the processing at Step S2. The captured image may be an image that is represented by the image data that were created by the processing at Step S2, and the captured image may also be an image that results from some sort of processing, such as correction processing or the like, that is performed on the image data that were created by the processing at Step S2. Any known image detection method may be used for detecting the reference marks 150. For example, the CPU 121 may detect the reference marks 150 by using edge extraction to extract the characteristic points. In the present embodiment, one characteristic point is extracted from each one of the reference marks 150. Based on the image data for the image that is shown in FIG. 8, the characteristic points P1 to P4 are extracted from the reference marks 151 to 154, respectively. In the present embodiment, the round, black patterns in the reference marks 150 are the same as the round, black patterns in the type mark 160. The CPU 121 may distinguish between the reference marks 150 and the type mark 160 based on the positioning of the characteristic points, for example.

The CPU 121 determines whether or not all four of the reference marks 150 have been successfully detected (Step S4). As described above, in the present embodiment, the reference marks 150 are provided in the vicinity of the four corners of the sewing area 45 on the top face of the first frame 55, respectively. Therefore, in a case where all four of the reference marks 150 are included in the captured image, the area inside the embroidery frame 53 and the indicator mark 110 are included in the captured image. Therefore, by the processing at Step S4, the portable terminal 3 confirms whether the four reference marks 150 are included in the captured image. In a case where at least one of the four reference marks 150 has not been detected (NO at Step S4), the CPU 121 displays an error message on the display portion 135 (Step S5) and returns the processing to Step Si. The error message in the processing at Step S5 notifies the user that at least one of the reference marks 150 was not detected in the captured image and prompts the user to perform the image capture again. The user may check the error message and, after adjusting the image capture range, may input a command to perform the image capture again.

In a case where all four of the reference marks 150 have been successfully detected (YES at Step S4), the CPU 121 outputs the image data created at Step S2 to the sewing machine 1 through the communication interface 125 (Step S6). In the present embodiment, the data that the portable terminal 3 transmits to the sewing machine 1 at Step S6 include an address for the portable terminal 3 and the image data. An address for the sewing machine 1 may be input by the user during the first processing, and the address may also be stored in a storage device such as the flash ROM 124 or the like in advance. The CPU 121 determines whether or not the image data have been successfully transmitted (Step S7). In a case where a successful receiving message has been received from the sewing machine 1, the CPU 121 determines that the image data have been successfully transmitted (YES at Step S7). In that case, the CPU 121 displays on the display portion 135 a message that notifies the user that the transmission of the image data was carried out normally (Step S9), and then terminates the first processing. In a case where the successful receiving message has not been received within a specified time period (for example, three minutes) after the image data were transmitted to the sewing machine 1 (NO at Step S7), the CPU 121 displays a transmission error message on the display portion 135 (Step S8), and then terminates the first processing. The transmission error message is a message that notifies the user that the transmission of the image data was not carried out normally.

The second processing that is performed by the sewing machine 1 will be explained with reference to FIGS. 9 to 11. The second processing is processing that sets the positioning of the embroidery pattern that has been selected by the user, based on the image data that have been transmitted from the portable terminal 3, and then forms the stitches that make up the embroidery pattern according to the positioning that has been set. Specifically, the sewing machine 1 computes positioning data based on the image data that have been transmitted from the portable terminal 3. The positioning data are data that indicate at least one of the position and the angle of the indicator mark 110 in relation to the reference marks 150. The positioning data of the present embodiment are data that indicate both the position and the angle of the indicator mark 110 in relation to the reference marks 150. Based on the positioning data, the sewing machine 1 sets at least one of the position and the angle of the embroidery pattern 200 on the sewing workpiece 5 that is clamped in the embroidery frame 53. In the present embodiment, based on the positioning data, the sewing machine 1 sets both the position and the angle of the embroidery pattern 200 on the sewing workpiece 5 that is clamped in the embroidery frame 53. Based on the position and the angle that have been set, and on the pattern data, the sewing machine 1 creates the embroidery data, which are the data for forming the stitches that make up the embroidery pattern 200. Based on the embroidery data, the sewing machine 1 controls the embroidery device 2 and the needle bar up-and-down moving mechanism 84 to sew the embroidery pattern 200 on the sewing workpiece 5 that is clamped in the embroidery frame 53.

The CPU 61 of the sewing machine 1 starts the second processing when the user inputs a command to start the second processing by a panel operation. When the CPU 61 detects the input of the command to start the second processing, the CPU 61 reads into the RAM 63 the program for performing the second processing, which is stored in the ROM 62 (refer to FIG. 4). In accordance with the instructions that are contained in the program, the CPU 61 performs the processing at the individual steps that will hereinafter be explained. In the present embodiment, the previously described first processing is performed at least between the processing at Step S41 and the processing at Step S42, which will be described later.

Figure 9:
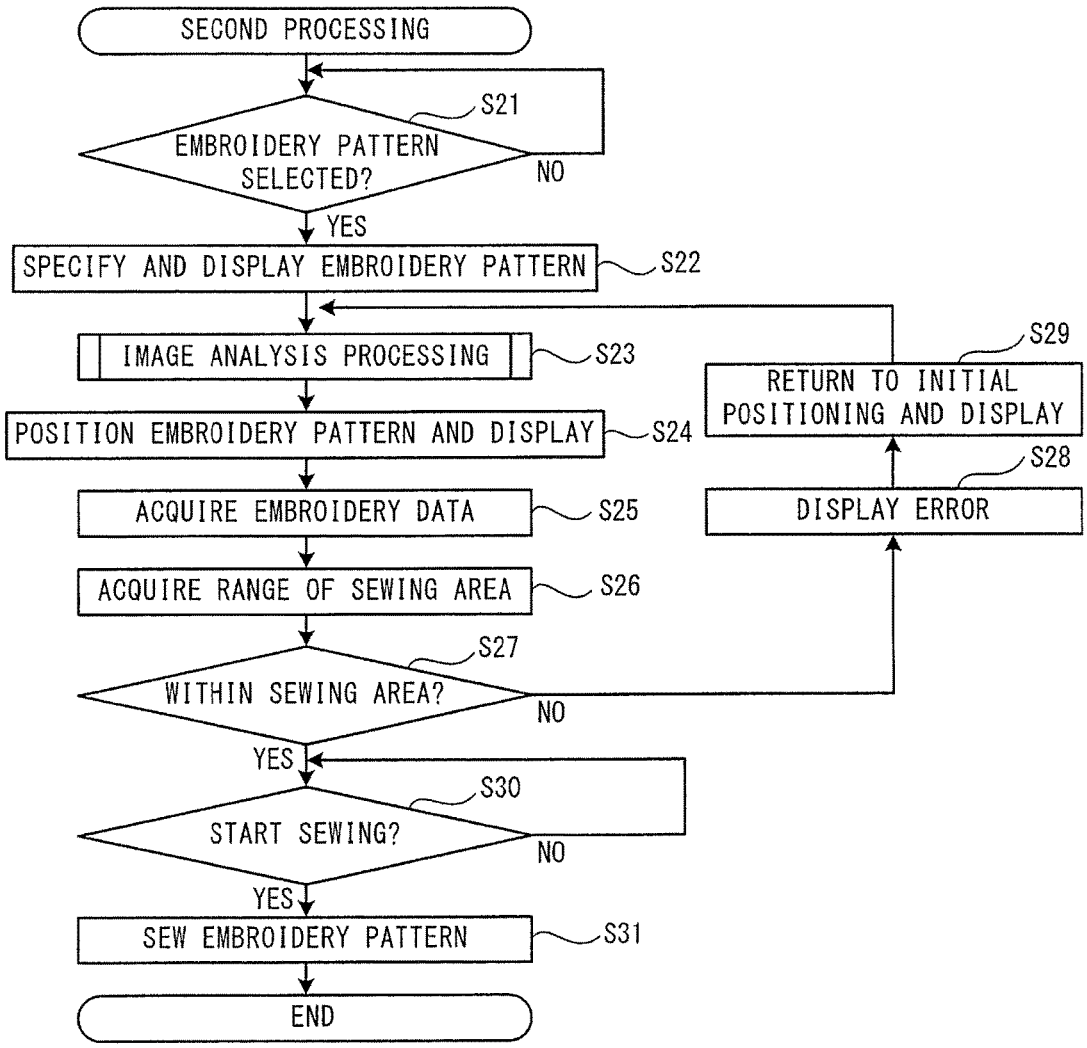
FIG. 9 is a flowchart of second processing that is performed by the sewing machine.

As shown in FIG. 9, in the second processing, first, the CPU 61 accepts the selecting of an embroidery pattern to be sewn (Step S21). Specifically, the CPU 61 causes the LCD 15 (refer to FIG. 1) to display a screen that shows a plurality of embroidery patterns for which the pattern data are stored in the flash ROM 64, for example. The CPU 61 waits for the user to select one of the displayed embroidery patterns by a panel operation (NO at Step S21). When the user selects one of the displayed embroidery patterns by a panel operation (YES at Step S21), the CPU 61 specifies the embroidery pattern that has been selected (hereinafter called the selected pattern) as an object to be sewn, and then displays the selected pattern on the LCD 15 (Step S22). The CPU 61 acquires the pattern data for the selected pattern from the ROM 62 and stores the pattern data in the RAM 63. In the explanation that follows, a case in which the embroidery pattern 200 in FIG. 6 has been specified as the selected pattern will be used as a specific example.

The CPU 61 performs image analysis processing to set the positioning of the embroidery pattern 200 specified at Step S22 (Step S23). The image analysis processing will be explained with reference to FIG. 10. As shown in FIG. 10, the CPU 61 waits until a command to start processing to receive the image data from the portable terminal 3 is input (NO at Step S41). The command may be input by the user by a panel operation, for example. When the command is input (YES at Step S41), the CPU 61 waits until data is received from the portable terminal 3 (NO at Step S42). In a case where the CPU 61 has received data from the portable terminal 3 (YES at Step S42), the CPU 61 determines whether or not the image data are included in the received data (Step S43). In a case where the image data are not included in the data received at Step S42 (NO at Step S43), the CPU 61 displays an error message on the LCD 15 (Step S44), and thereafter returns the processing to Step S41. The error message in the processing at Step S44 is a message that notifies the user that the image data have not been received and prompts the user to perform the first processing once again using the portable terminal 3. In a case where the image data are included in the data received at Step S42 (YES at Step S43), the CPU 61 transmits the above-described successful receiving message to the portable terminal 3 (Step S45). As described above, the successful receiving message is used by the portable terminal 3 to confirm that the image data have been received normally by the sewing machine 1.

The CPU 61 determines whether or not the embroidery frame 53 has been mounted on the embroidery device 2, based on the result of detection by the detection portion 27 (refer to FIG. 4) (Step S46). In a case where the embroidery frame 53 has not been mounted on the embroidery device 2 (NO at Step S46), the CPU 61 causes the LCD 15 to display a message that prompts the user to mount the embroidery frame 53 on the embroidery device 2 (Step S47), and returns the processing to Step S46. In a case where the embroidery frame 53 has been mounted on the embroidery device 2

(YES at Step S46), the CPU 61 specifies the type of the embroidery frame 53 that is mounted on the embroidery device 2, based on the result of detection by the detection portion 27 (Step S48).

The CPU 61 detects the reference marks 150 in the captured image based on the image data (Step S49). The captured image in the processing at Step S49 may be an image that is represented by the image data acquired by the processing at Step S42, and the captured image may also be an image that results from some sort of processing, such as correction processing or the like, that is performed on the image data acquired by the processing at Step S42. In the same manner as the processing at Step S3 in FIG. 7, any known image detection method may be used for detecting the reference marks 150. For example, the CPU 61 may detect the reference marks 150 by using edge extraction to extract the characteristic points. In the present embodiment, one characteristic point is extracted from each one of the reference marks 150. Based on the image data for the image that is shown in FIG. 8, the characteristic points P1 to P4 are extracted from the reference marks 151 to 154, respectively. In the processing at Step S49, the CPU 61 detects, as reference positions, the positions of the respective characteristic points P1 to P4 of the reference marks 150 within the captured image.

The CPU 61 determines whether or not all four of the reference marks 150 have been successfully detected (Step S50). In a case where at least one of the four reference marks 150 has not been detected (NO at Step S50), the CPU 61 displays an error message on the LCD 15 (Step S58), and thereafter returns the processing to Step S42. The error message in the processing at Step S58 notifies the user that at least one of the reference marks 150 was not detected based on the captured image and prompts the user to perform the image capture again using the portable terminal 3. The user may check the error message and may adjust the image capture range by operating the portable terminal 3. The user may then input the image capture command once again. In a case where all four of the reference marks 150 have been detected successfully (YES at Step S50), the CPU 61 acquires the actual relative position for each one of the characteristic points P1 to P4 included in the reference marks 150 that are in accordance with the type of the embroidery frame 53, in relation to a standard position (Step S51). At Step S51, the CPU 61 acquires the actual relative position for each one of the characteristic points P1 to P4 in relation to the standard position, based on the type of the embroidery frame 53 specified by the processing at Step S48 and on the sewing area table stored in the flash ROM 64. In the present embodiment, the standard position is the origin point of the embroidery coordinate system, and the relative positions are expressed in terms of the coordinates of the embroidery coordinate system. By the processing at Step S51, the CPU 61 acquires the coordinates (X21, Y21), (X22, Y22), (X23, Y23), and (X24, Y24) as the relative positions for the characteristic points P1 to P4, respectively.

Based on the image data, the CPU 61 detects the orientation of the embroidery frame 53 within the captured image. In the present embodiment, the CPU 61 determines that, of the four sides of the substantially rectangular first frame 55, the side where the type mark 160 is located is the front side. Therefore, in the image in FIG. 8, the CPU 61 determines that the bottom side of the captured image is the front side of the embroidery frame 53, and that the center points of the round, black patterns in the upper left, the upper right, the lower right, and the lower left of the image in FIG. 8 respectively correspond to the characteristic points P1 to P4 of the reference marks 151 to 154. Based on the orientation of the embroidery frame 53, the CPU 61 assigns the coordinates (X21, Y21), (X22, Y22), (X23, Y23), and (X24, Y24) to the corresponding characteristic points P1 to P4 in the captured image (Step S52). For each of the characteristic points P1 to P4 of the reference marks 150, in the processing at Step S52, the CPU 61 sets the relative position in relation to the corresponding reference position. The reference position is the position of the characteristic point in the captured image.

Based on the correspondence relationships between the reference positions and the relative positions for the characteristic points P1 to P4 of the reference marks 150, the CPU 61 corrects the image that is represented by the image data that were acquired at Step S42 (Step S53). In the processing at Step S53 of the present embodiment, the CPU 61 corrects distortion in the captured image by using a known keystone correction method. In the processing at Step S53, the CPU 61 converts the captured image that is shown in FIG. 8 into the captured image that is shown in FIG. 11. The captured image that is shown in FIG. 11 is equivalent to an image that would be obtained when the embroidery frame 53 that holds the sewing workpiece 5 is placed in a horizontal state and the image is captured from directly above the embroidery frame 53. The up-down direction and the left-right direction in FIG. 11 respectively correspond to the Y axis direction and the X axis direction in the embroidery coordinate system.

Based on the image data, the CPU 61 detects the indicator mark 110 in the captured image (Step S54). Any known image recognition method may be used for detecting the indicator mark 110. For example, the CPU 61 may perform edge extraction and perform pattern matching using a template that shows the outlines of the first circle 101 and the second circle 102, as well as the line segments 103 to 106. For example, within the captured image, in the processing at Step S54, the CPU 61 may detect the positions of the two characteristic points in the indicator mark 110 as indicator positions. In a case where the indicator mark 110 is not detected (NO at Step S55), there is a strong possibility that the indicator mark 110 has not been affixed in an appropriate position or that the indicator mark 110 is not located within the image capture range. Accordingly, the CPU 61 displays an error message on the LCD 15 (Step S57), and thereafter returns the processing to Step S42. The error message in the processing at Step S57 is a message that prompts the user to affix the indicator mark 110 again in an area inside the sewing area 45 of the embroidery frame 53.

In a case where the indicator mark 110 is detected (YES at Step S55), the CPU 61 computes, as the positioning data, data that indicate the position and the angle of the indicator mark 110 in relation to the reference marks 150 (Step S56). Hereinafter, the position and the angle of the indicator mark 110 will simply be called the positioning of the indicator mark 110. The plurality (specifically, four) of the reference marks 150 are positioned on the embroidery frame 53, and their relative positions are known. Therefore, the CPU 61 is able to acquire the coordinates in the embroidery coordinate system that correspond to the indicator positions by computing the coordinates based on the reference positions of the plurality of the characteristic points P1 to P4 that are included in the plurality of the reference marks 150, on the known relative positions that correspond to the reference positions, and on the indicator positions. Each of the indicator positions is a position, in the captured image, of each of the at least one characteristic point that is included in the indicator mark 110. In the present embodiment, the indicator mark 110 has the two characteristic points of the first center point 111 and the second center point 112. Accordingly, the CPU 61 may compute, as the positioning data, data that indicate the coordinates in the embroidery coordinate system of the first center point 111 and the second center point 112 of the indicator mark 110 that was detected at Step S54, for example. The coordinates of the first center point 111 in the embroidery coordinate system represent the position of the indicator mark 110 on the sewing workpiece 5, and are used to indicate the position of the embroidery pattern 200. The coordinates of the first center point 111 and the second center point 112 in the embroidery coordinate system represent the angle of the indicator mark 110, and are used to indicate the angle of the embroidery pattern 200. In addition to being represented by the coordinates of the first center point 111 and the second center point 112 in the embroidery coordinate system, the angle of the indicator mark 110 may be represented by an angle in relation to a reference (for example, the X axis or the Y axis of the embroidery coordinate system). The CPU 61 thus ends the image analysis processing and returns the processing to the second processing shown in FIG. 9.

Figure 10:
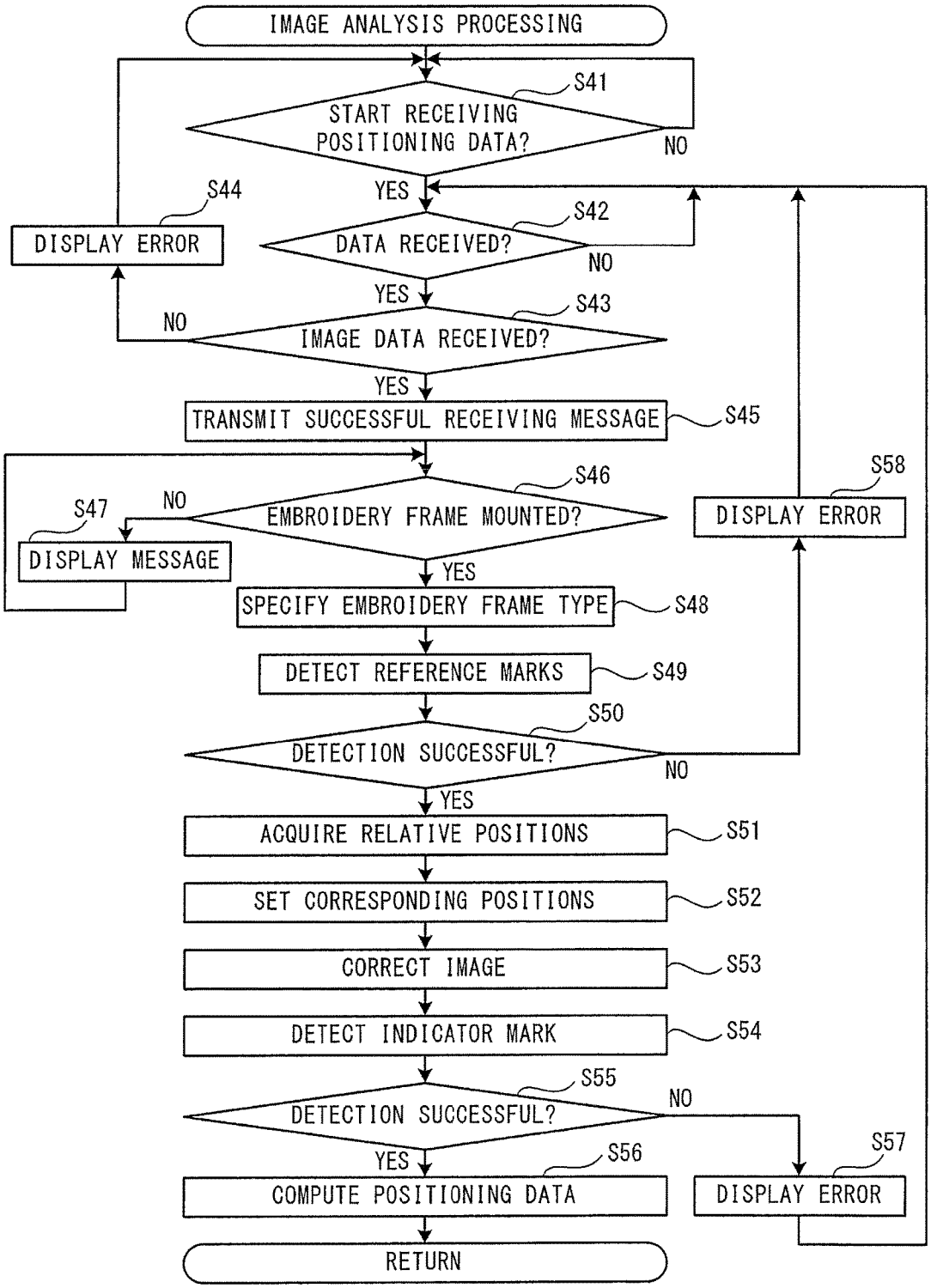
FIG. 10 is a flowchart of image analysis processing that is performed in the second processing shown in FIG. 9.
Figure 11:
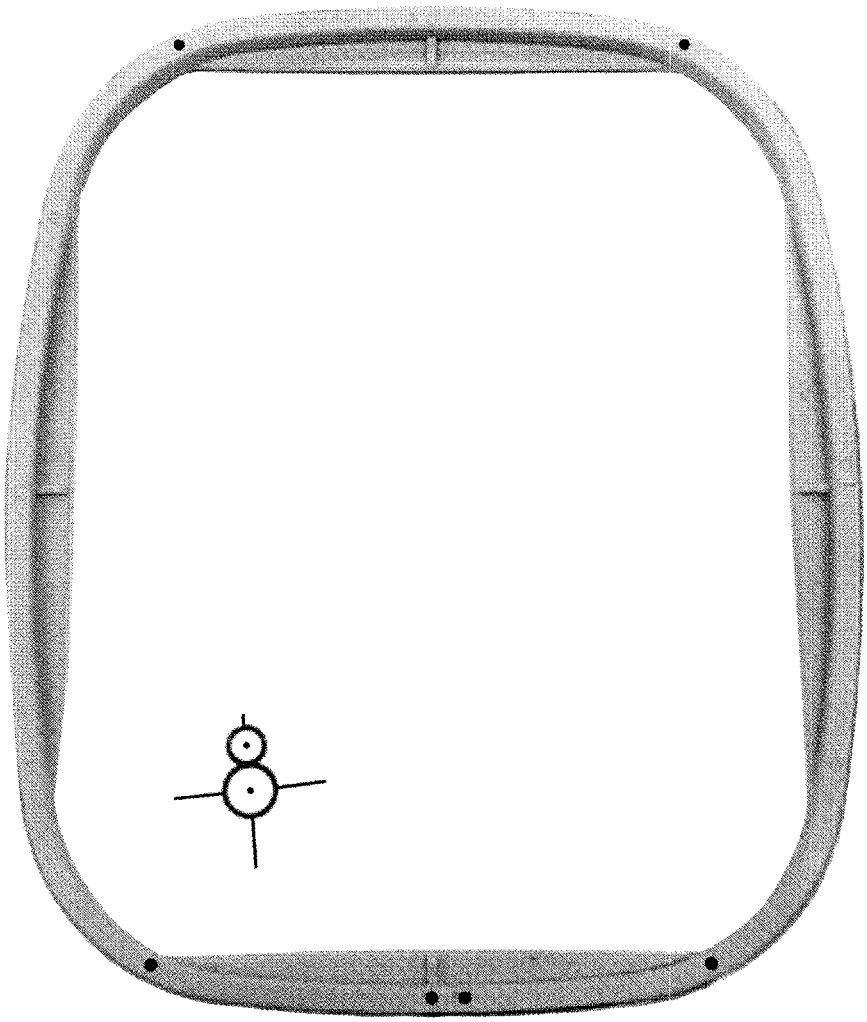
FIG. 11 is a captured image that is represented by image data after correction, in a case where the image data acquired from the portable terminal are corrected.

As shown in FIG. 9, after the image analysis processing (Step S23), the CPU 61 sets the positioning of the embroidery pattern 200 based on the pattern data for the embroidery pattern 200 specified at Step S22 and on the positioning data computed at Step S56 in FIG. 10, and displays the set positioning on the LCD 15 (Step S24). In the specific example, as shown in FIG. 2, the CPU 61 sets the positioning of the embroidery pattern 200 in relation to the embroidery frame 53 such that the center point 202 of the embroidery pattern 200 (more specifically, the center point of the rectangle 201 that is the smallest rectangle within which the embroidery pattern 200 can be contained) is congruent with the first center point 111 of the indicator mark 110 in the embroidery coordinate system. The CPU 61 sets the angle of the embroidery pattern 200 in relation to the embroidery frame 53 such that the slope of the line segment that links the center point 202 of the embroidery pattern 200 to the point 203 matches the slope of the line segment that links the first center point 111 and the second center point 112 of the indicator mark 110 in the embroidery coordinate system.

The CPU 61 corrects the pattern data such that the center point 202 of the embroidery pattern 200 is congruent with the first center point 111 of the indicator mark 110 in the embroidery coordinate system. The CPU 61 corrects the pattern data such that the slope of the line segment that links the center point 202 of the embroidery pattern 200 to the point 203 matches the slope of the line segment that links the first center point 111 and the second center point 112 of the indicator mark 110 in the embroidery coordinate system. The CPU 61 acquires the corrected pattern data as the embroidery data (Step S25).

The CPU 61 acquires information that indicates the range of the sewing area 45 that corresponds to the type of the embroidery frame 53 specified at Step S48 in FIG. 10 (Step S26). In the specific example, the CPU 61 refers to the sewing area table that is stored in the flash ROM 64, and acquires the X axis length X25 and the Y axis length Y25 that represent, in terms of the embroidery coordinate system, the size of the sewing area 45 for the embroidery frame 53 for which the ID is 2. By the processing at Step S26, the CPU 61 sets the sewing area 45 shown in FIG. 2 inside the first frame 55 of the embroidery frame 53. Based on the positioning of the embroidery pattern 200 that was set by the processing at Step S24 and on the information that represents the sewing area 45 that was acquired at Step S26, the CPU 61 determines whether or not the embroidery pattern 200 can fit within the sewing area 45 when the embroidery pattern 200 is positioned as set by the processing at Step S24 (Step S27). In a case where the rectangle 201 that is the smallest rectangle within which the embroidery pattern 200 can be contained fits entirely within the sewing area 45, the CPU 61 determines that the embroidery pattern 200 can fit within the sewing area 45. In a case where the embroidery pattern 200 cannot fit within the sewing area 45 (NO at Step S27), the CPU 61 displays an error message on the LCD 15 (Step S28). The error message in the processing at Step S28 is a message that notifies the user that the embroidery pattern 200 cannot fit within the sewing area 45 and prompts the user to perform again the operations that set the positioning of the embroidery pattern 200. The CPU 61 returns the positioning of the embroidery pattern 200 to the positioning prior to the performing of the processing at Step S24 (the initial positioning) and displays the initial positioning on the LCD 15 (Step S29), and thereafter returns the processing to Step S23.

In a case where, as shown in FIG. 2, the embroidery pattern 200 can fit within the sewing area 45 (YES at Step S27), the CPU 61 waits until a command to start sewing is input. (NO at Step S30). The command to start sewing may be input by the user, using one of a panel operation and the operation switches 21. In a case where the command to start sewing has been input (YES at Step S30), the CPU 61 performs processing that sews the embroidery pattern 200 on the sewing workpiece 5 in accordance with the embroidery data that were acquired at Step S25 (Step S31). More specifically, the CPU 61 causes the embroidery device 2 to move the embroidery frame 53 by driving the X axis motor 82 and the Y axis motor 83 (refer to FIG. 4) in accordance with the embroidery data. By driving the sewing machine motor 79 to drive the needle bar up-and-down moving mechanism 84 in coordination with the moving of the embroidery frame 53, the CPU 61 moves the needle bar 29, on which the sewing needle 28 is mounted, up and down, thus sewing the embroidery pattern 200 on the sewing workpiece 5 that is clamped in the embroidery frame 53. When the sewing of the embroidery pattern 200 is finished, the CPU 61 terminates the second processing.

According to the above-described sewing machine system 100, the sewing machine 1 can compute the positioning data based on the image data that were created and transmitted by the portable terminal 3. Therefore, the sewing machine 1 that is not provided with an image capture device can use the image data to compute the positioning data of the indicator mark on the sewing workpiece, which heretofore could only be done by a sewing machine that is provided with an image capture device. The sewing machine 1 and the portable terminal 3 can perform communication via the network 9. Therefore, in comparison to a case in which the sewing machine 1 and the portable terminal 3 are connected via a cable, an operation is simple when the portable terminal 3 outputs the image data to the sewing machine 1.

With a known sewing machine that is provided with an image capture device that has an image capture range that is smaller than the sewing area 45 in the embroidery frame 53, cases occur in which the CPU must divide the entire sewing area 45 into a plurality of blocks, and then perform processing that detects the indicator mark 110 by successively moving the embroidery frame 53 to positions that correspond to the individual blocks. In contrast to this, the portable terminal 3 in the present embodiment is a separate unit from the sewing machine 1. When the portable terminal 3 creates the image data, there is no restriction on the image capture range. In a state in which the embroidery frame 53 has been removed from the embroidery device 2, for example, the portable terminal 3 is able to create the image data by capturing a single image that includes both the reference marks 150 and the indicator mark 110 that is positioned in the area within the embroidery frame 53. Furthermore, by capturing an image of the embroidery frame 53 in a state in which it has been removed from the embroidery device 2, the portable terminal 3 is able to create the image data in a state in which elements of the sewing machine 1 (for example, the needle bar 29 and the presser foot 30) are not included in the image capture range. The sewing machine 1 is able to make the processing that detects the indicator mark 110 based on the image data simpler than it would be in a case where the elements of the sewing machine are included in the image capture range.

The sewing machine 1 is able to compute the positioning data by detecting the reference marks 150, the indicator mark 110, and the type mark 160 in the captured image, and automatically determining the type of the embroidery frame 53 and the orientation of the embroidery frame 53 within the captured image. Therefore, the user does not need to consider the orientation of the embroidery frame 53 within the captured image at the time when the image is captured. The user also does not need to input information to the portable terminal 3 for specifying the orientation of the embroidery frame 53 within the captured image. The sewing machine 1 can reliably avoid a situation in which the positioning data cannot be computed properly due to an inappropriate setting of the correspondence relationship between the orientation of the embroidery frame 53 within the captured image and the orientation at which the embroidery frame 53 is mounted on the embroidery device 2.

The embroidery device 2 of the present embodiment is configured such that a selected one of a plurality of types of the embroidery frames 53 can be mounted thereon. The size and the shape of the embroidery frame 53 vary according to the type of the embroidery frame 53. By the processing at Step S48, the sewing machine 1 can automatically detect the type of the embroidery frame 53 and can automatically acquire the relative positions that correspond to the type of the embroidery frame 53. Thus, the sewing machine 1 can omit troublesome operations of the user, such as inputting the information to specify the type of the embroidery frame 53 or specifying the relative positions that correspond to the type of the embroidery frame 53.

The sewing machine 1 is able to notify the user that at least one of the reference marks 150 and the indicator mark 110 has not been detected. Based on the result of the notification, the user is able to respond by performing the image capture again or the like. The sewing machine 1 is able to make the acquiring of the positioning data more convenient for the user than it would be in a case where the user is not notified that at least one of the reference marks 150 and the indicator mark 110 has not been detected. The portable terminal 3 transmits the image data to the sewing machine 1 when the four reference marks 150 are included in the captured image. Therefore, basically, there is no case in which the four reference marks 150 are not detected by the sewing machine 1. Therefore, the sewing machine system 100 can improve the convenience of the user in comparison to a case in which the four reference marks 150 may not be detected by the sewing machine 1.

Various types of modifications may be made to the sewing machine 1 in the embodiment that is described above. For example, at least one of the modifications in the examples (A) to (E) that are described below may be applied as desired.

(A) The configuration of the sewing machine 1 may be modified as desired. The sewing machine 1 may be a different type of sewing machine, such as an industrial sewing machine, a multi-needle sewing machine, or the like, for example. The sewing machine may also be a sewing machine that is configured as an integrated unit with the embroidery device, for example. Instead of being stored in the flash ROM 64, the pattern data for the embroidery pattern may be stored in another storage device (for example, the ROM 62) in the sewing machine 1. In a case where the sewing machine 1 includes a structural element to which a storage medium such as a memory card or the like can be connected, the sewing machine 1 may acquire pattern data that are stored in the storage medium and store the pattern data in a storage device (for example, the flash ROM 64) of the sewing machine 1. In a case where the sewing machine 1 includes a structural element to which an external device can be connected, either by wire or wirelessly, the sewing machine 1 may acquire pattern data that are stored in the external device and store the pattern data in a storage device. The sewing workpiece may be any object in which a stitch can be formed.

A device that is provided with an image capture device may be any device other than the portable terminal 3, such as a mobile telephone that is not a smartphone, a digital camera that is provided with a computation function, or the like, for example. A CCD camera or the like may be used as the image capture device, as long as the image capture device can capture an image and output the image data of the image. The structure of the embroidery frame, such as its shape, size, or the like, may be modified as desired. For example, the embroidery frame may be such that the clamping portion of the embroidery frame includes an upper frame (a first frame) and a lower frame (a second frame) and that the upper frame and the lower frame are configured to clamp the sewing workpiece from above and below. In that case, in a state in which the sewing workpiece is clamped, the visible position on the side that faces the needle bar of the sewing machine is on the top face of the upper frame.

(B) The configurations of the various types of marks (the indicator mark 110, the reference marks 150, and the type mark 160) may each be modified as desired. For example, at least one of the size, the material, the design, and the color of a mark may be modified. The characteristic points of the marks that are used in the processing that is described above may be modified as desired. In a case where the marks that are described above include line segments that intersect one another, for example, the CPU 121 may identify a point of intersection as a characteristic point. The CPU 121 may also identify an endpoint of a line segment as a characteristic point.

The number of the indicator marks 110 and the number of the characteristic points that any one indicator mark 110 contains can be modified as desired. In a case where the positioning of the embroidery pattern is specified based on a plurality of the indicator marks 110, the positioning of the embroidery pattern, particularly the angle of the embroidery pattern, can be set with greater precision than in a case where the positioning of the embroidery pattern is specified based on one indicator mark 110, based on the image data. It is acceptable for the CPU 61 to detect at least one of the position and the angle of the indicator mark 110 as the positioning of the indicator mark 110. The characteristic points (in the embodiment that is described above, the first center point 111 and the second center point 112 of the indicator mark 110) for specifying the positioning of the indicator mark 110 and the method for computing the positioning may be modified as desired, taking into account the structure and the like of the indicator mark 110.

In the same manner, the number of the reference marks 150 and the number of the characteristic points that any one reference mark 150 contains can be modified as desired. For example, in a case where one reference mark includes a plurality of characteristic points, it is acceptable for only one reference mark to be provided. In a case where the CPU 61 performs keystone correction based on the characteristic points of the reference marks, as in the embodiment that is described above, it is preferable that at least one reference mark that includes a total of at least four characteristic points is provided.

(C) The configurations of the pattern data and the embroidery data and the methods for creating the pattern data and the embroidery data, may be modified as desired. For example, in a case where the embroidery pattern is a pattern to be sewn in a plurality of colors, the pattern data and the embroidery data may include thread color data. The thread color data indicate the colors of the threads that will form the stitches. The setting of the coordinates in the embroidery coordinate system may be determined in advance and may be modified as desired. The coordinate system for the coordinates that are indicated by the positioning data that are computed based on the image data may be different from the embroidery coordinate system, as long as the coordinates can be converted between the two systems. In that case, the sewing machine 1 may perform processing that converts the positioning data into data for the embroidery coordinate system.

(D) The program that contains the instructions for performing the first processing in FIG. 7, and the data for the first processing, may be stored in a storage device in the portable terminal 3 by the time the portable terminal 3 executes the program. The program that contains the instructions for performing the second processing in FIG. 9, and the data for the second processing, may be stored in a storage device in the sewing machine 1 by the time the sewing machine 1 executes the program. Therefore, the method for acquiring the program and the pattern data, the route by which the program and the pattern data are acquired, and the device that stores the program may each be modified as desired. The programs that the processors of the portable terminal 3 and the sewing machine 1 execute, as well as the pattern data, may be received from another device through a cable or by wireless communication and may be stored in a storage device such as a flash memory or the like. The other device may be one of a PC and a server that is connectable through a network.

(E) The individual steps of the first processing in FIG. 7 may not necessarily be performed by the CPU 121, and some or all of the steps may be performed by another electronic device (for example, an ASIC). The individual steps of the above-described first processing may also be performed through distributed processing by a plurality of electronic devices (for example, a plurality of CPUs). The order of the individual steps of the first processing in the embodiment that is described above may also be modified as necessary, and steps may also be omitted and added. Furthermore, based on a command from the CPU 121, the operating system (OS) or the like that is running in the portable terminal 3 may perform some or all of the actual processing, and the functions of the embodiment that is described above may be implemented by that processing. In the same manner, the individual steps of the second processing in FIG. 9 may not necessarily be performed by the CPU 61, and some or all of the steps may be performed by another electronic device (for example, an ASIC). The individual steps of the above-described second processing may also be performed through distributed processing by a plurality of electronic devices (for example, a plurality of CPUs). The order of the individual steps of the second processing in the embodiment that is described above may also be modified as necessary, and steps may also be omitted and added. Furthermore, based on a command from the CPU 61, the operating system (OS) or the like that is running in the sewing machine 1 may perform some or all of the actual processing, and the functions of the embodiment that is described above may be implemented by that processing. For example, at least one of the modifications in the examples (E-1) to (E-5) that are described below may be applied as desired.

(E-1) In a case where only one type of the embroidery frame 53 can be mounted in the sewing machine 1, in a case where the user inputs the type of the embroidery frame 53, and the like, the processing at Step S48 in FIG. 10 may be omitted. Further, the type of the embroidery frame 53 may be detected based on the type mark 160 in the captured image. In that case, the CPU 61 may compare the type of the embroidery frame 53 detected based on the detection result of the detection portion 27 with the type of the embroidery frame 53 detected based on the type mark 160, and may determine whether or not the types of the embroidery frame 53 match. In a case where it is determined that the types of the embroidery frame 53 do not match, the embroidery frame 53 of a different type from the embroidery frame 53 used for the image capture has been attached to the embroidery device 2. In that case, the CPU 61 may display an error message on the LCD 15. By doing this, based on the error message, the user can understand that the embroidery frame 53 of a different type from the embroidery frame 53 used for the image capture has been attached to the embroidery device 2. In that case, in the sewing machine system 100, it is possible to avoid a situation in which sewing of the embroidery pattern is performed in a state in which the embroidery frame 53 of a different type from the embroidery frame 53 used for the image capture has been attached to the embroidery device 2.

(E-2) In a case where the orientation of the embroidery frame 53 in the captured image is fixed, the sewing machine 1 may omit the processing at Step S52 that specifies the orientation of the embroidery frame 53 in the captured image. In that case, the sewing machine 1 may associate each one of the plurality of the characteristic points that are included in the reference marks 150 in the captured image with the corresponding relative position according to predetermined relationships. Specifically, in a case where the up-down direction and the left-right direction in the image that is shown in FIG. 8 respectively correspond to the front-rear direction and the left-right direction of the embroidery frame 53, the sewing machine 1 may associate the characteristic points in the upper left, the upper right, the lower right, and the lower left of the image with the relative positions of the characteristic points P1 to P4, respectively. It is not necessary for the CPU 61 to specify the orientation of the embroidery frame 53 in the captured image based on the positioning of the type mark 160. For example, in a case where the reference mark 150 has directionality, such as in a case where the reference mark 150 is the same sort of mark as the indicator mark 110, for example, the CPU 61 may specify the orientation of the embroidery frame 53 in the captured image based on the orientation that is indicated by the reference mark 150.

(E-3) Some or all of the processing at Steps S5, S8, and S9 in FIG. 7 can be omitted as necessary. In the same manner, some or all of the processing at Steps S28 in FIGS. 9, S44, S47, S57, and S58 in FIG. 10 can be omitted as necessary. At each of the steps cited above, the notification may be provided by audio instead of by the processing that displays the error message.

(E-4) The sewing machine 1 and the portable terminal 3 may also be configured not to be connectable to the network 9. In that case, the sewing machine 1 and the portable terminal 3 may also be connectable through a communication cable. In that case, the portable terminal 3 outputs the image data to the sewing machine 1 through the communication cable in the processing at Step S6 in FIG. 7. The sewing machine 1 may acquire the image data that have been output through the communication cable.

(E-5) The CPU 61 of the sewing machine 1 may set one of the position and the angle of the embroidery pattern based on the positioning data. For example, in a case where the CPU 61 sets the position of the embroidery pattern based on the positioning data, the CPU 61 may set the angle of the embroidery pattern to an initial angle. The reference to be used when the CPU 61 sets one of the position and the angle of the embroidery pattern based on the positioning data may be set in advance, and may be modified as desired.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

an embroidery frame moving portion that is configured to be removably mounted with an embroidery frame and to move the embroidery frame in a movement direction;

a sewing portion that is configured to form a stitch in a sewing workpiece that is clamped in the embroidery frame, a processor; and a memory that is configured to store computer-readable instructions that, when executed by the processor, cause the processor to perform the steps of:

acquiring image data that are created by a device that is different from the sewing machine, the image data being image data that are obtained by capturing an image of a range that includes at least one reference mark and at least one indicator mark, the at least one reference mark being provided on the embroidery frame, and the at least one indicator mark being positioned in an area inside the embroidery frame, on the sewing workpiece that is clamped in the embroidery frame;

computing positioning data based on the image data, the positioning data being data that indicate at least one of a position and an angle of the at least one indicator mark in relation to the at least one reference mark;

specifying an embroidery pattern to be formed in the sewing workpiece that is clamped in the embroidery frame;

setting at least one of a position and an angle of the embroidery pattern on the sewing workpiece, based on the positioning data;

acquiring embroidery data, the embroidery data being data for forming stitches that make up the embroidery pattern, at the at least one of the position and the angle of the embroidery pattern on the sewing workpiece; and causing the embroidery frame moving portion and the sewing portion to form the stitches that make up the embroidery pattern in the sewing workpiece, based on the embroidery data.

2. The sewing machine according to claim 1, wherein the computing of the positioning data includes:

acquiring first positions, the first positions being actual relative positions of characteristic points in relation to a specified second position, the characteristic points being characteristic points that are included in the at least one reference mark;

detecting third positions, the third positions being respective positions of the characteristic points in a captured image, the captured image being an image that is based on the image data;

detecting at least one fourth position, the at least one fourth position being a position of the at least one indicator mark in the captured image; and computing the positioning data based on the third positions, the first positions that respectively correspond to the third positions of the characteristic points, and the at least one fourth position.

3. The sewing machine according to claim 2, wherein the computing of the positioning data further includes:

detecting an orientation of the embroidery frame in the captured image, based on the image data; and setting the first positions that respectively correspond to the third positions for the corresponding characteristic points, based on the orientation of the embroidery frame.

4. The sewing machine according to claim 2, wherein the memory is further configured to store correspondence relationships between types of embroidery frames and the first positions of the characteristic points that are included in the at least one reference mark that is provided on each of the embroidery frames, and the acquiring of the first positions includes:

specifying a type of the embroidery frame; and acquiring the first positions that correspond to the type of the embroidery frame, by referring to the memory.

5. The sewing machine according to claim 4, further comprising:

a detection portion that is configured to detect the type of the embroidery frame that is mounted on the embroidery frame moving portion, wherein the specifying of the type of the embroidery frame includes specifying the type of the embroidery frame based on a detection result of the detection portion.

6. The sewing machine according to claim 2, wherein the computer-readable instructions further cause the processor to perform the steps of:

determining whether the at least one reference mark and the at least one indicator mark have been detected in the captured image; and providing notification that at least one of the at least one reference mark and the at least one indicator mark has not been detected, in response to a determination that at least one of the at least one reference mark and the at least one indicator mark has not been detected.

7. A non-transitory computer-readable medium storing computer-readable instructions that, when executed by a processor of a sewing machine comprising an embroidery frame moving portion configured to be removably mounted with an embroidery frame and to move the embroidery frame in a movement direction and a sewing portion configured to form a stitch in a sewing workpiece clamped in the embroidery frame, cause the processor to perform the steps of:

acquiring image data that are created by a device that is different from the sewing machine, the image data being image data that are obtained by capturing an image of a range that includes at least one reference mark and at least one indicator mark, the at least one reference mark being provided on the embroidery frame, and the at least one indicator mark being positioned in an area inside the embroidery frame, on the sewing workpiece that is clamped in the embroidery frame;

computing positioning data based on the image data, the positioning data being data that indicate at least one of a position and an angle of the at least one indicator mark in relation to the at least one reference mark;

specifying an embroidery pattern to be formed in the sewing workpiece that is clamped in the embroidery frame;

setting at least one of a position and an angle of the embroidery pattern on the sewing workpiece, based on the positioning data;

acquiring embroidery data, the embroidery data being data for forming stitches that make up the embroidery pattern, at the at least one of the position and the angle of the embroidery pattern on the sewing workpiece; and causing the embroidery frame moving portion and the sewing portion to form the stitches that make up the embroidery pattern in the sewing workpiece, based on the embroidery data.

8. The non-transitory computer-readable medium according to claim 7, wherein the computing of the positioning data includes:

acquiring first positions, the first positions being actual relative positions of characteristic points in relation to a specified second position, the characteristic points being characteristic points that are included in the at least one reference mark;

detecting third positions, the third positions being respective positions of the characteristic points in a captured image, the captured image being an image that is based on the image data;

detecting at least one fourth position, the at least one fourth position being a position of the at least one indicator mark in the captured image; and computing the positioning data based on the third positions, the first positions that respectively correspond to the third positions of the characteristic points, and the at least one fourth position.

9. The non-transitory computer-readable medium according to claim 8, wherein the computing of the positioning data further includes:

detecting an orientation of the embroidery frame in the captured image, based on the image data; and setting the first positions that respectively correspond to the third positions for the corresponding characteristic points, based on the orientation of the embroidery frame.

10. The non-transitory computer-readable medium according to claim 8, wherein the acquiring of the first positions includes:

specifying a type of the embroidery frame; and acquiring the first positions that correspond to the type of the embroidery frame, by referring to a memory, the memory being configured to store correspondence relationships between types of embroidery frames and the first positions of the characteristic points that are included in the at least one reference mark that is provided on each of the embroidery frames.

11. The non-transitory computer-readable medium according to claim 10, wherein the sewing machine further includes a detection portion that is configured to detect the type of the embroidery frame that is mounted on the embroidery frame moving portion, and the specifying of the type of the embroidery frame includes specifying the type of the embroidery frame based on a detection result of the detection portion.

12. The non-transitory computer-readable medium according to claim 8, wherein the computer-readable instructions further cause the processor to perform the steps of:

determining whether the at least one reference mark and the at least one indicator mark have been detected in the captured image; and providing notification that at least one of the at least one reference mark and the at least one indicator mark has not been detected, in response to a determination that at least one of the at least one reference mark and the at least one indicator mark has not been detected.

13. A sewing machine system, comprising:

a sewing machine;

an embroidery frame; and a device, wherein the sewing machine includes:

an embroidery frame moving portion that is configured to removably mounted with the embroidery frame and to move the embroidery frame in a movement direction;

a sewing portion that is configured to form a stitch in a sewing workpiece that is clamped in the embroidery frame, the sewing portion including a needle bar;

a first processor; and a first memory that is configured to store computer-readable instructions that, when executed by the first processor, cause the first processor to perform the steps of:

acquiring image data that are created by the device, the image data being image data that are obtained by capturing an image of a range that includes at least one reference mark and at least one indicator mark, the at least one reference mark being provided on the embroidery frame, and the at least one indicator mark being positioned in an area inside the embroidery frame, on the sewing workpiece that is clamped in the embroidery frame;

computing positioning data based on the image data, the positioning data being data that indicate at least one of a position and an angle of the at least one indicator mark in relation to the at least one reference mark;

specifying an embroidery pattern to be formed in the sewing workpiece that is clamped in the embroidery frame;

setting at least one of a position and an angle of the embroidery pattern on the sewing workpiece, based on the positioning data;

acquiring embroidery data, the embroidery data being data for forming stitches that make up the embroidery pattern, at the at least one of the position and the angle of the embroidery pattern on the sewing workpiece; and causing the embroidery frame moving portion and the sewing portion to form the stitches that make up the embroidery pattern in the sewing workpiece, based on the embroidery data, the embroidery frame includes:

a mounting portion that is configured to be mounted on and removed from the embroidery frame moving portion; and a clamping portion that includes a first frame and a second frame, the first frame and the second frame being configured to clamp a sewing workpiece, the clamping portion having the at least one reference mark that is disposed at a visible position on a side of the clamping portion that is opposite the needle bar in a state in which the sewing workpiece is clamped, and the device includes:

an image capture portion that is configured to create image data;

a second processor; and a second memory that is configured to store computer-readable instructions that, when executed by the second processor, cause the second processor to perform the steps of:

causing the image capture portion to create the image data by causing the image capture portion to capture the image of the range that includes the at least one reference mark and the at least one indicator mark; and outputting the image data to the sewing machine.

* * * * *